US006452548B2

(12) United States Patent
Nagumo et al.

(10) Patent No.: US 6,452,548 B2
(45) Date of Patent: Sep. 17, 2002

(54) SURFACE MOUNT ANTENNA AND COMMUNICATION DEVICE INCLUDING THE SAME

(75) Inventors: Shoji Nagumo, Kawasaki; Kazunari Kawahata, Machida; Nobuhito Tsubaki, Shiga-ken; Takashi Ishihara, Machida; Kengo Onaka, Yokohama, all of (JP)

(73) Assignee: Murata Manufacturing Co., Ltd. (JP)

( * ) Notice: Subject to any disclaimer, the term of this patent is extended or adjusted under 35 U.S.C. 154(b) by 2 days.

(21) Appl. No.: 09/776,600

(22) Filed: Feb. 2, 2001

(30) Foreign Application Priority Data

Feb. 4, 2000 (JP) ..... 2000-027634

(51) Int. Cl.[7] ..... H01Q 1/38

(52) U.S. Cl. ..... 343/700 MS; 343/702; 343/873; 343/895

(58) Field of Search ..... 343/700 MS, 702, 343/846, 848, 873, 895, 893

(56) References Cited

U.S. PATENT DOCUMENTS 5,861,854 A * 1/1999 Kawahata et al. ..... 343/702
5,867,126 A * 2/1999 Kawahata et al. ..... 343/702
5,959,582 A * 9/1999 Kawahata et al. ... 343/700 MS
6,028,567 A * 2/2000 Lahti ..... 343/702
6,034,640 A * 3/2000 Oida et al. ..... 343/722
6,124,831 A * 9/2000 Rutkowski et al. .. 343/700 MS
6,147,650 A * 11/2000 Kawahata et al. ... 343/700 MS

* cited by examiner

*Primary Examiner*—Don Wong
*Assistant Examiner*—Shih-Chao Chen
(74) *Attorney, Agent, or Firm*—Ostrolenk, Faber, Gerb & Soffen, LLP

(57) ABSTRACT

In a feeding radiation electrode of a surface mount antenna, a series inductance component such as a meander pattern is formed locally in a maximum resonance current part in a high-order mode (second-order mode) so as to locally form a series inductance component therein thereby making the maximum resonance current part have a greater electrical length per unit physical length than the other parts. This makes it possible to control the difference between the resonance frequency in a fundamental mode and the resonance frequency in the high-order mode over a large range. Furthermore, it is possible to vary the resonance frequency in the second-order mode independently of the resonance frequency in the fundamental mode by varying the number of lines or the line-to-line distance of the meander pattern thereby varying the value of the series inductance component. Thus, it is possible to easily and efficiently design a surface mount antenna having a frequency characteristic which satisfies requirements needed in multi-band applications without having to change the basic design.

28 Claims, 20 Drawing Sheets

SURFACE MOUNT ANTENNA AND COMMUNICATION DEVICE INCLUDING THE SAME

BACKGROUND OF THE INVENTION

1. Field of the Invention

The present invention relates to a surface mount antenna capable of transmitting and receiving signals (radio waves) in different frequency bands and also to a communication device such as a portable telephone including such an antenna.

2. Description of the Related Art

In recent years, it is needed to commercially provide a single terminal having a multi-band capability for use in plural applications such as GSM (Global System for Mobile communication systems), DCS (Digital Cellular System), PDC (Personal Digital Cellular telecommunication system), and PHS (Personal Handyphone System). To meet the above requirement, Japanese Unexamined Patent Application Publication No. 11-214917 discloses a multiple frequency antenna of the surface mount type capable of transmitting and receiving signals in different frequency bands.

In this antenna, as shown in FIG. 22A, a dielectric member 105 is disposed on a ground plate 101, and a conductive plate 102 having a cut-out 106 is disposed on the upper surface of the dielectric member 105. When a signal is supplied via a feeding line 104, a current in a fundamental mode flows through the conductive plate 102, along a path L1 from the side of a short-circuiting plate 103 toward the opposite side, and a current in a high-order mode (third-order mode in this specific example) flows along a path L3. Thus, this antenna has a frequency characteristic such as that shown in FIG. 22B and is capable of transmitting and receiving signals at two different frequencies: a resonance frequency f1 in the fundamental mode; and a resonance frequency f3 in the high-order mode.

Note that in the present description, the fundamental mode refers to a resonance mode having the lowest resonance frequency of those in various resonance modes, and the high-order modes refer to resonance modes having resonance frequencies higher than the resonance frequency in the fundamental mode. When it is necessary to distinguish the respective high-order modes from each other, they are denoted by a second-order mode, a third-order mode, and so on in the order of increasing resonance frequencies.

In the case where currents in the fundamental mode and a high-order mode are passed through the same conductive plate 102 from its one end to the opposite end as in the conventional antenna described above, the difference between the resonance frequencies in the respective modes is determined by the difference between the lengths of the current paths. In general, the distance from one end to the opposite end of the conductive plate 102 is determined on the basis of the fundamental mode such that it becomes substantially equal to one-quarter the effective wavelength 1 in the fundamental mode (in other words, the resonance frequency in the fundamental mode is determined by the above-described distance). In order to set the resonance frequency in a high-order mode to a desired value, it is required that the length of the current path in the high-order mode should be different by a corresponding amount from the length of the current path in the fundamental mode. In the conventional technique described above, a difference in current path length is created by forming the cut-out 106 at a location where the current in the high-order mode becomes maximum thereby changing the current path L3 in the high-order mode so as to have a greater length required to set the resonance frequency f3 in the high-order mode to the desired value.

In the conventional technique described above, because the same conductive plate 102 is used for resonance in both the fundamental mode and the high-order mode, the size of the antenna can be reduced compared with the size of an antenna in which resonance in the fundamental mode and resonance in the high-order mode are achieved using different conductive plates. However, in the conventional technique described above, it is required that the cut-out 106 should be formed in the conductive plate 102, and thus the conductive plate 102 should be large enough to form the cut-out 106. This makes it difficult to achieve a further reduction in the size of the antenna.

Furthermore, in the conventional technique described above, the current path in the high-order mode is curved by the cut-out 106 thereby increasing the length thereof. Therefore, the change in the length of the current path is limited within a small range determined by the change in the perimeter of the cut-out 106 (that is, the change in the shape of the cut-out 106). Thus, it is difficult to set the difference between the resonance frequency in the fundamental mode and the resonance frequency in the high-order mode over a large range.

Furthermore, it is difficult to precisely control the resonance frequency in the high-order mode by adjusting the perimeter (shape) of the cut-out 106, and thus it is difficult to efficiently produce and provide an antenna having high performance and high reliability.

SUMMARY OF THE INVENTION

In view of the above, it is an object of the present invention to efficiently and economically provide a high-performance, high-reliability, small-sized surface mount antenna having features that the difference between the resonance frequencies in the fundamental mode and the high-order mode can be adjusted and set over a wide range, and both the resonance frequencies in the fundamental mode and the high-order mode can be precisely set to desired values, and also to provide a communication device including such an excellent antenna.

According to an aspect of the present invention, to achieve the above object, there is provided a surface mount antenna comprising: a dielectric substrate; and a radiating electrode formed on the dielectric substrate, one end of the radiating electrode being an open end, a feeding electrode or a ground terminal being formed on the opposite end of the radiating electrode, wherein the radiating electrode includes a first part having a small electrical length per unit physical length and a second part having a greater electrical length than the small electrical length, the first part and the second part being arranged in series along a current path between the one end and the opposite end.

According to another aspect of the present invention, there is provided a surface mount antenna comprising: a dielectric substrate; and a radiating electrode formed on the dielectric substrate, one end of the radiating electrode being an open end, a feeding electrode or a ground terminal being formed on the opposite end of the radiating electrode, wherein the radiating electrode includes a first part in which a resonance current in a fundamental mode becomes maximum and a second part in which a resonance current in a high-order mode becomes maximum, the first part and the second part being arranged in series along a current path between the one end and the opposite end; and at least one of the first and second parts includes an inductance component disposed in series in the current path.

Preferably, the inductance component is formed by a meander electrode pattern.

Alternatively, the inductance component may be formed by a capacitance component connected in parallel to the first part or the second part.

The radiating electrode may be formed by a helical electrode pattern, and the inductance component may be formed by reducing the distance between adjacent electrodes of the helical electrode pattern.

The inductance component may also be formed by a member having a high dielectric constant, the member being disposed in the first part or the second part.

The surface mount antenna may further comprise a non-feeding radiation electrode formed adjacent the radiating electrode, the resonance mode associated with the non-feeding radiation electrode forms multiple resonance in conjunction with at least one of the fundamental mode and the high-order mode associated with the externally-connected electrode.

The non-feeding radiation electrode may include a part having a small electrical length per unit physical length and a part having a greater electrical length than the small electrical length, the parts being arranged in series along a path of a current flowing through the non-feeding radiation electrode.

The non-feeding radiation electrode may include a first part in which a resonance current in a fundamental mode becomes maximum and a second part in which a resonance current in a high-order mode becomes maximum, the first part and the second part being arranged in series along a path of a current flowing through the non-feeding radiation electrode, and at least one of the first and second parts may include an inductance component disposed in series in the current path.

The inductance component may be formed by a meander electrode pattern.

Alternatively, the inductance component may be formed by a capacitance component connected in parallel to the first part or the second part.

The radiating electrode may be formed by a helical electrode pattern, and the inductance component may be formed by reducing the distance between adjacent electrodes of the helical electrode pattern.

The inductance component may also be formed by a member having a high dielectric constant, the member being disposed in the first part or the second part.

Preferably, the vector direction of a current flowing though the radiating electrode and the vector direction of a current flowing though the non-feeding radiation electrode are perpendicular to each other.

According to another aspect of the present invention, there is provided a communication device including one of the surface mount antennas described above.

In the present invention, for example, a meander pattern is formed in one of or both of maximum resonance current parts in the fundamental mode and the high-order mode in the current path of the feeding radiation electrode so that a series inductance component is locally added therein thereby making the electrical length per unit physical length therein become greater than in the other parts. Thus, the feeding radiation electrode includes a series of parts which are arranged such that the electrical length per unit physical length is alternately large and small from one part to another.

As described above, it is possible to vary the difference between the resonance frequency in the fundamental mode and the resonance frequency in the high-order mode by locally adding the series inductance component in one of or both of the maximum resonance current part in the fundamental mode and the maximum resonance current part in the high-order mode thereby increasing the electrical length therein. Furthermore, by locally changing the value of the series inductance component, it is possible to easily change the resonance frequency in the mode associated with the series inductance component added in the maximum resonance current parts, independently of the other mode. Besides, the change or adjustment of the resonance frequency by means of changing the series inductance component can be performed over a large range. Therefore, it is possible to adjust or set the difference between the resonance frequency in the fundamental mode and the resonance frequency in the high-order mode over a large range. This makes it possible to easily and efficiently provide a surface mount antenna having a frequency characteristic satisfying requirements needed in a terminal for use in multi-band applications. Furthermore, the degree of freedom for the design of the antenna is improved. Besides, a reduction in cost of the surface mount antenna can be achieved, and the performance and the reliability of the surface mount antenna can be improved.

The meander pattern or the like used to add the series inductance component can be added without causing a significant increase in the area of the feeding radiation electrode, and thus it is possible to realize a surface mount antenna having a small size.

BRIEF DESCRIPTION OF THE DRAWING(S)

FIG. 1, comprising FIGS. 1A, 1B, 1C and 1D, illustrates a surface mount antenna according to a first embodiment of the present invention;

FIG. 2 is a graph illustrating typical current and voltage distributions along a feeding radiation electrode of a surface mount antenna for each mode;

FIG. 3, comprising FIGS. 3A and 3B, are graphs illustrating an example of the dependence of the resonance frequency upon the number of meander lines of a meander pattern according to the first embodiment;

Figure 9A:
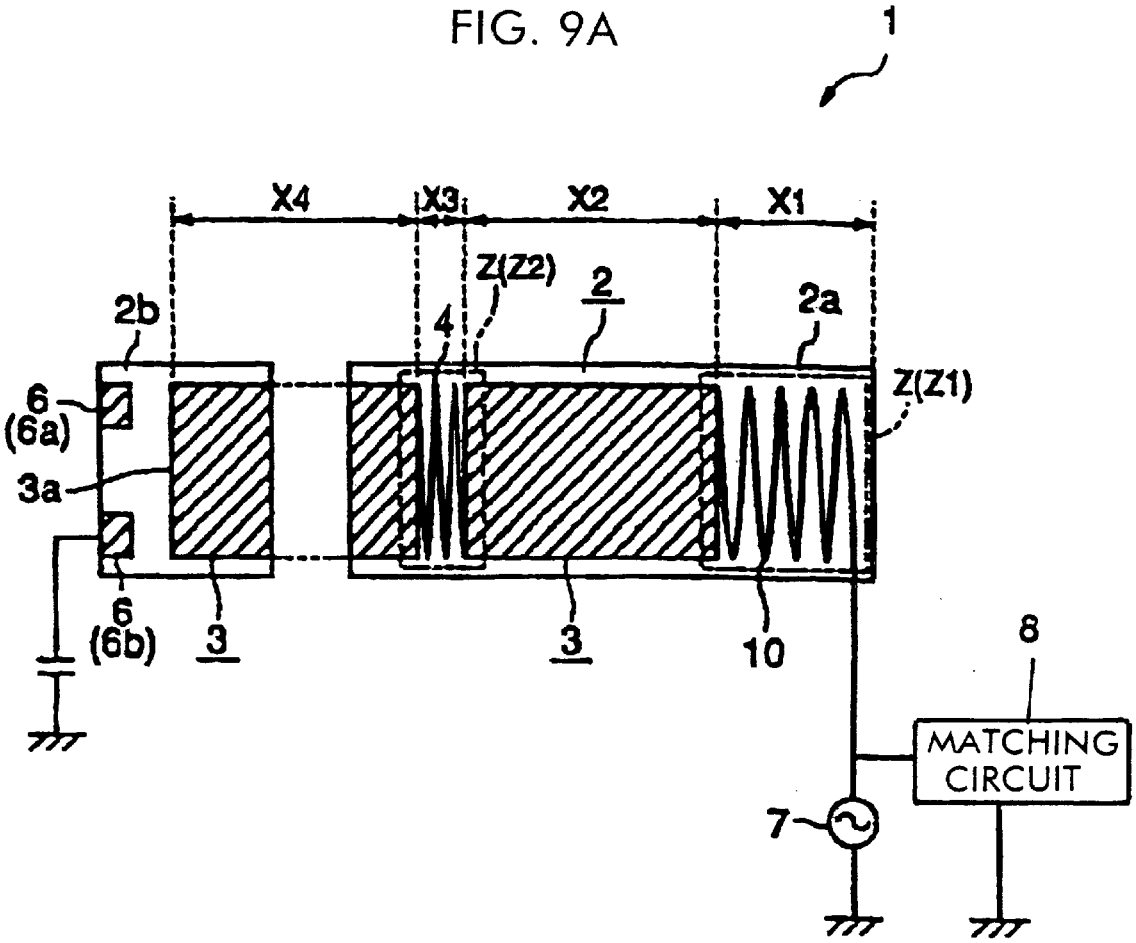
Figure 9B:
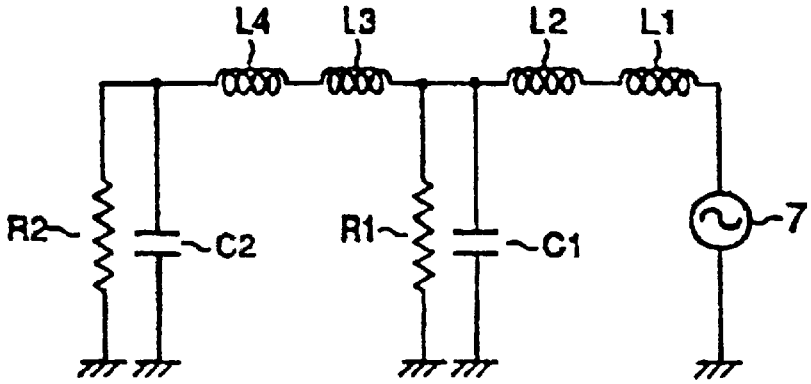
Figure 10A:
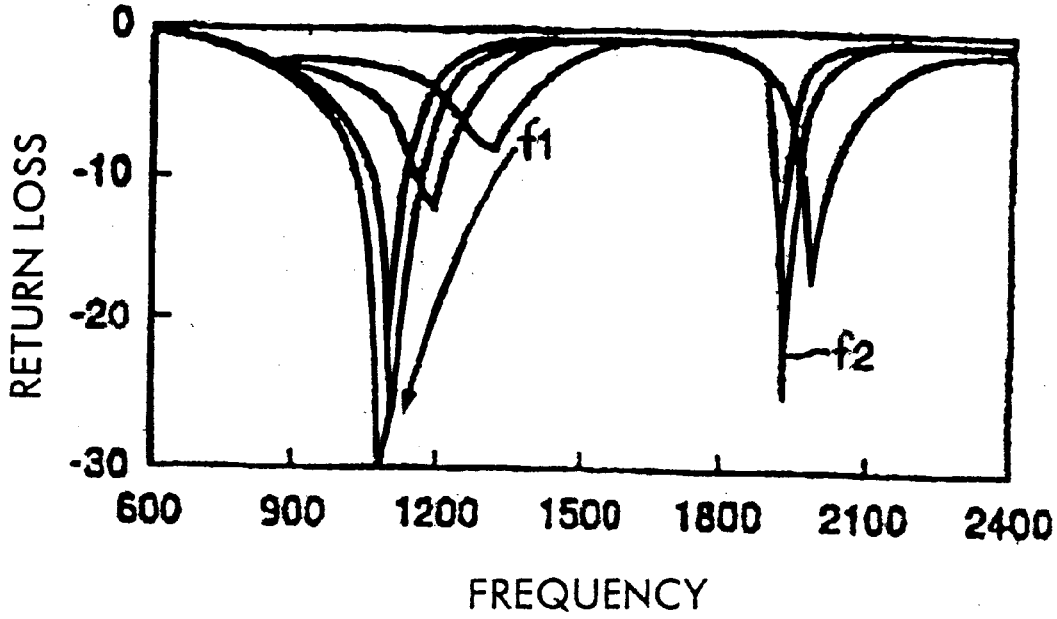
Figure 11A:
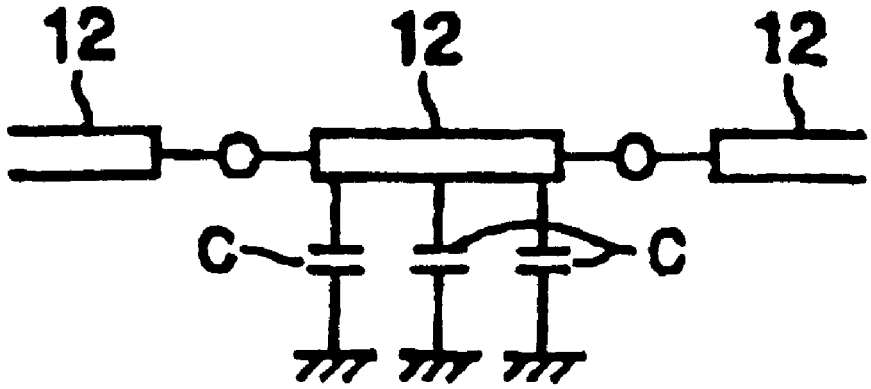
Figure 11B:
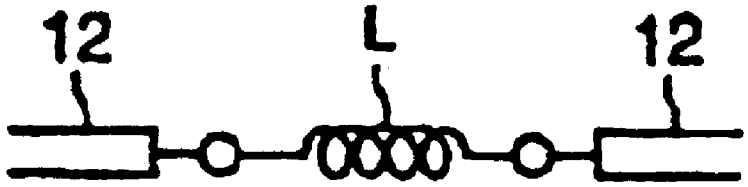
Figure 12A:
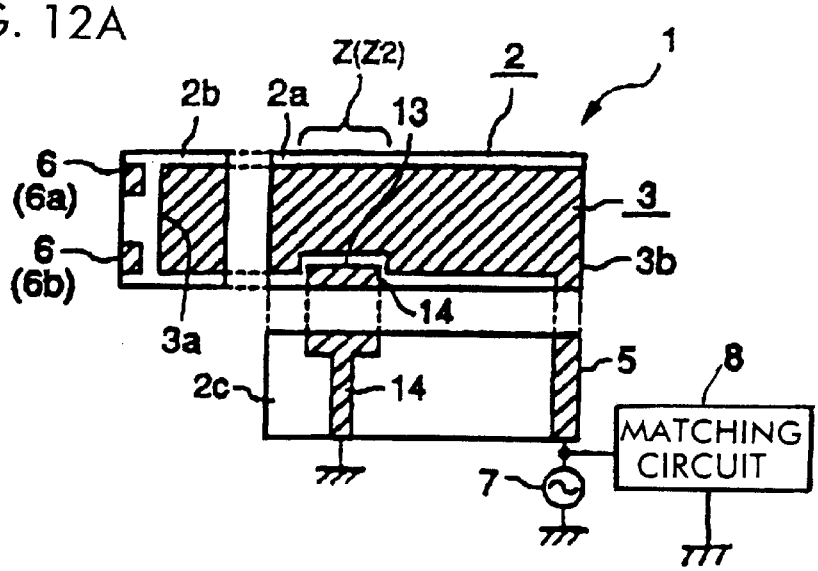
Figure 12B:
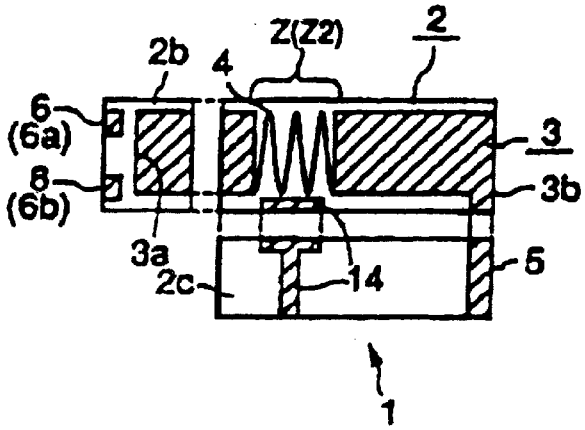
Figure 12C:
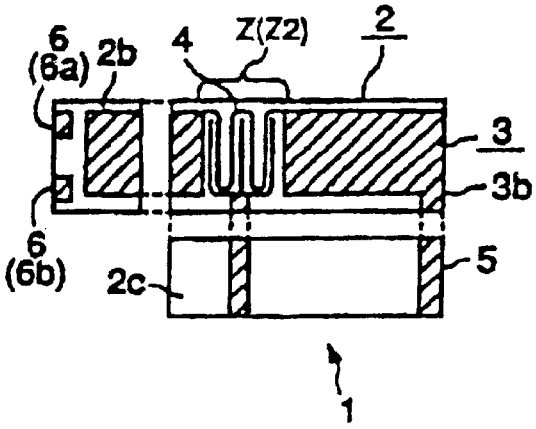
Figure 13A:
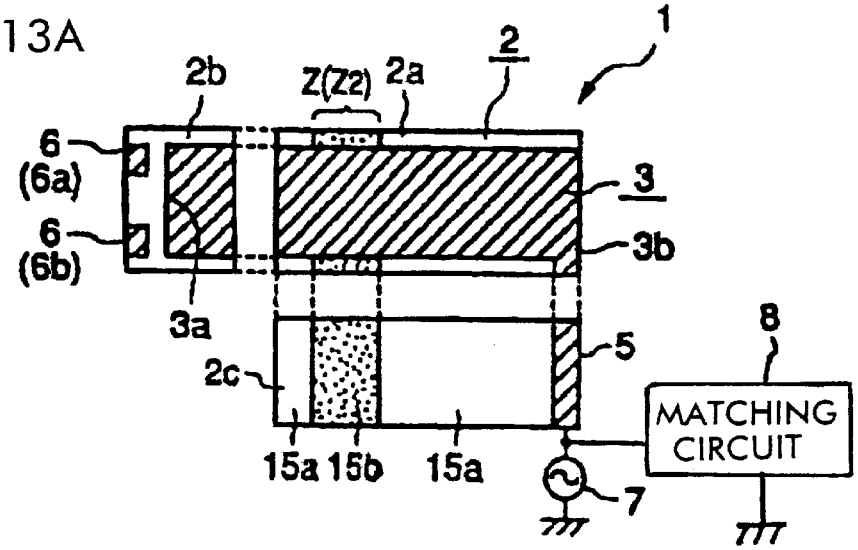
Figure 13B:
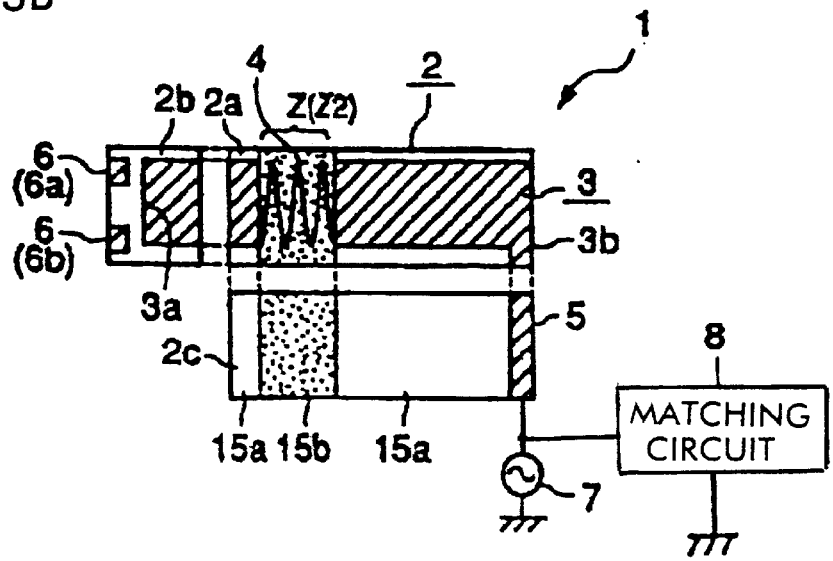
Figure 14:
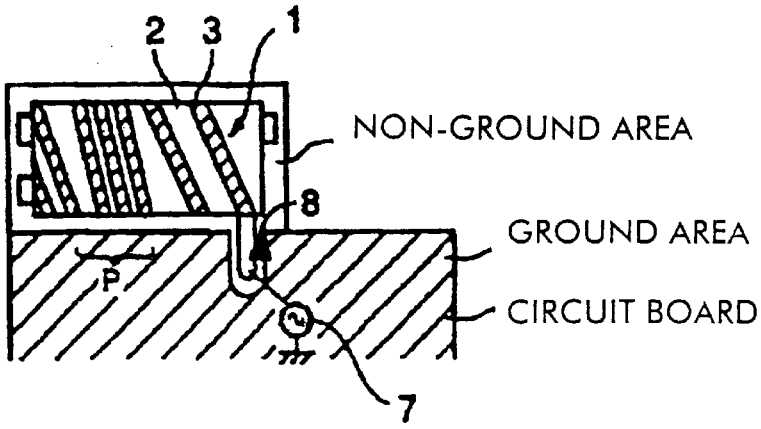
Figure 17A:
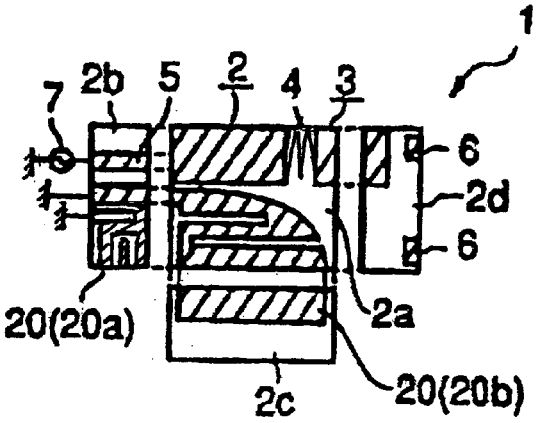
Figure 17B:
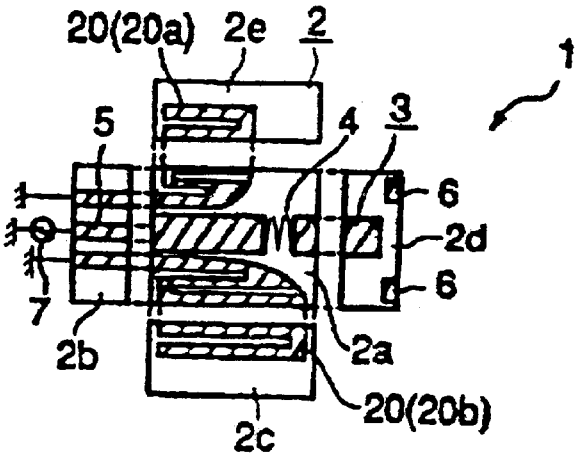
Figure 17C:
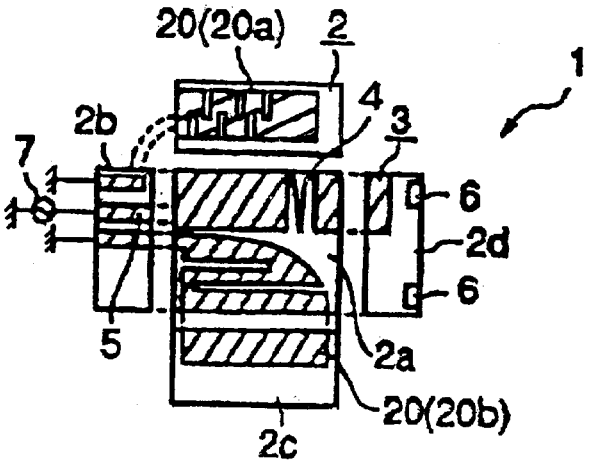
Figure 18A:
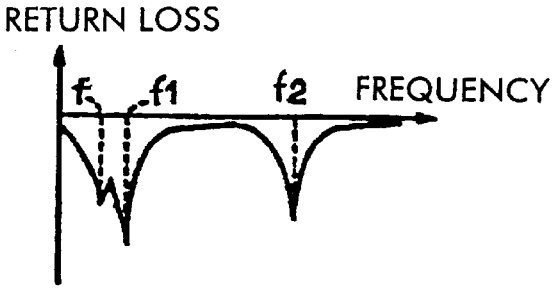
Figure 18B:
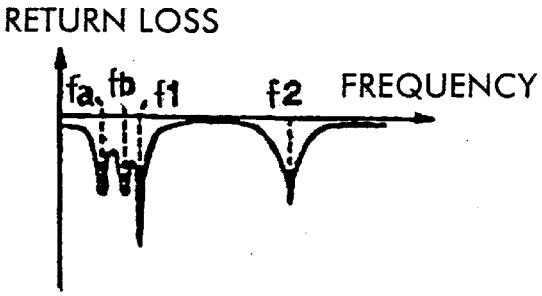
Figure 18C:
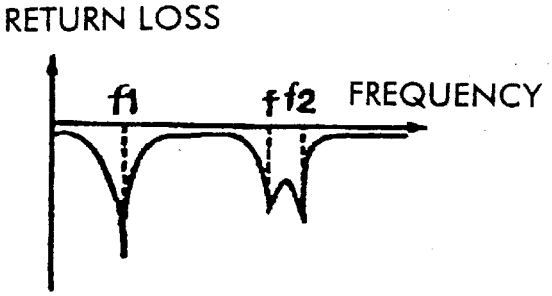
Figure 19A:
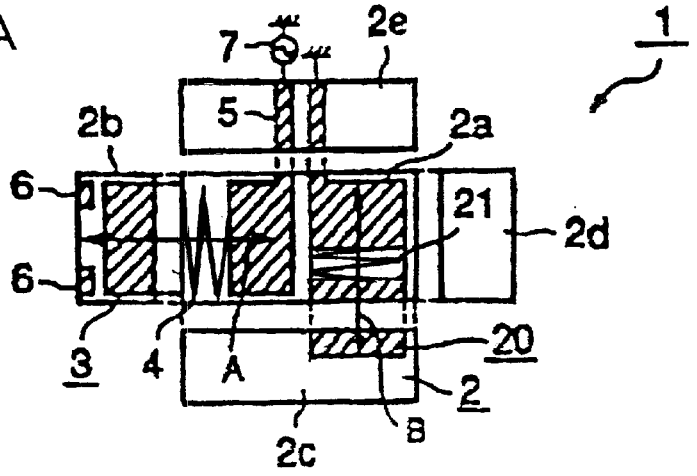
Figure 19B:
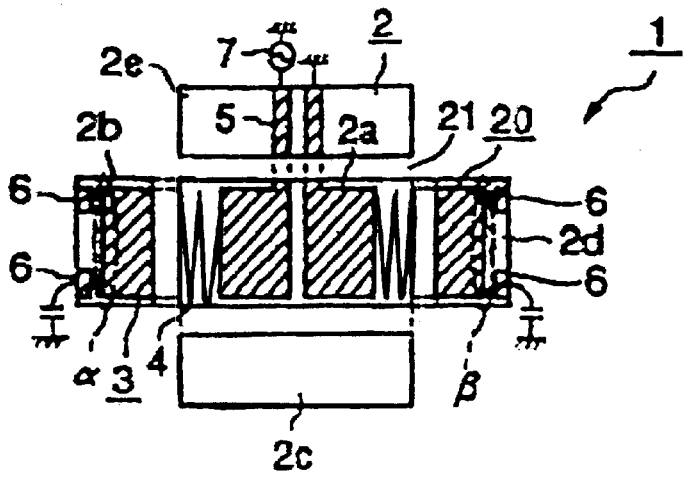
Figure 19C:
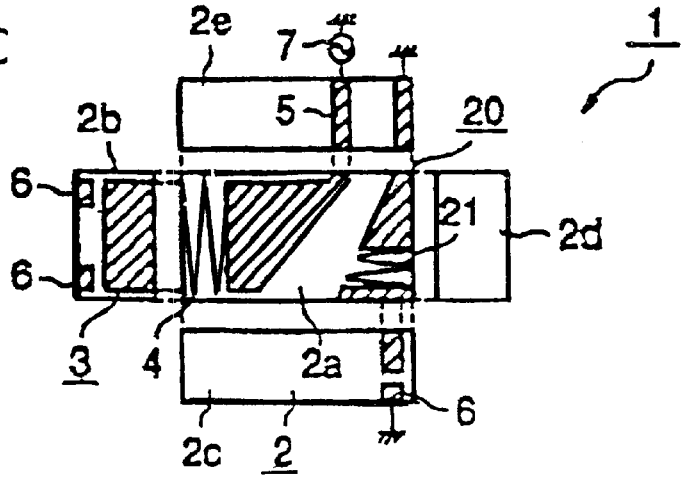
Figure 20A:
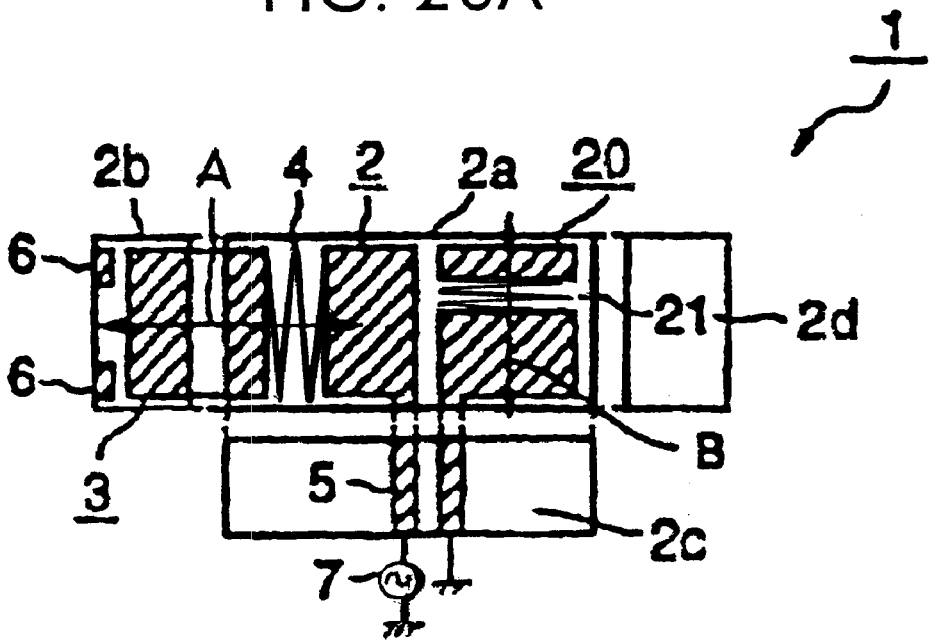
Figure 20B:
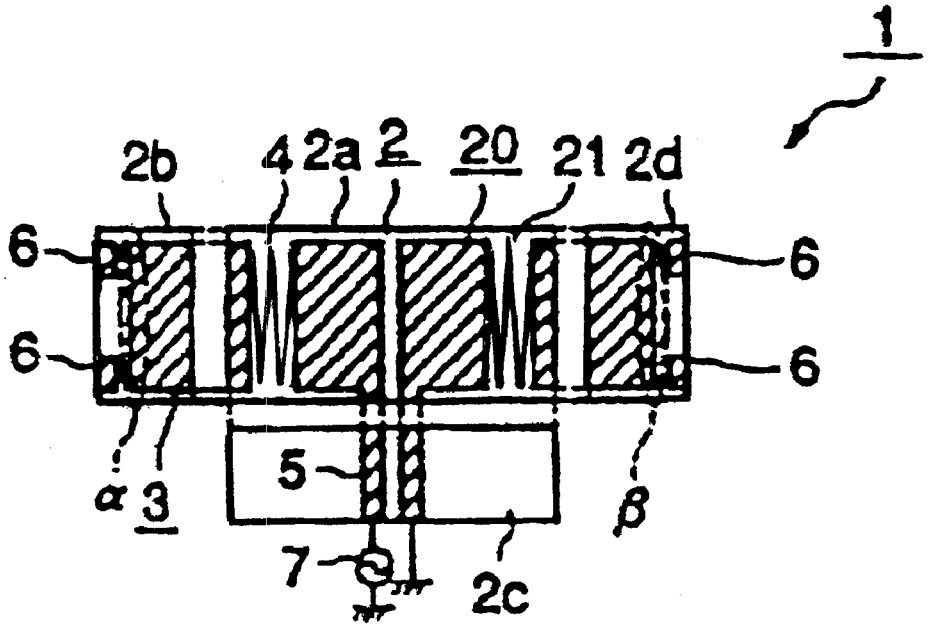
Figure 21:
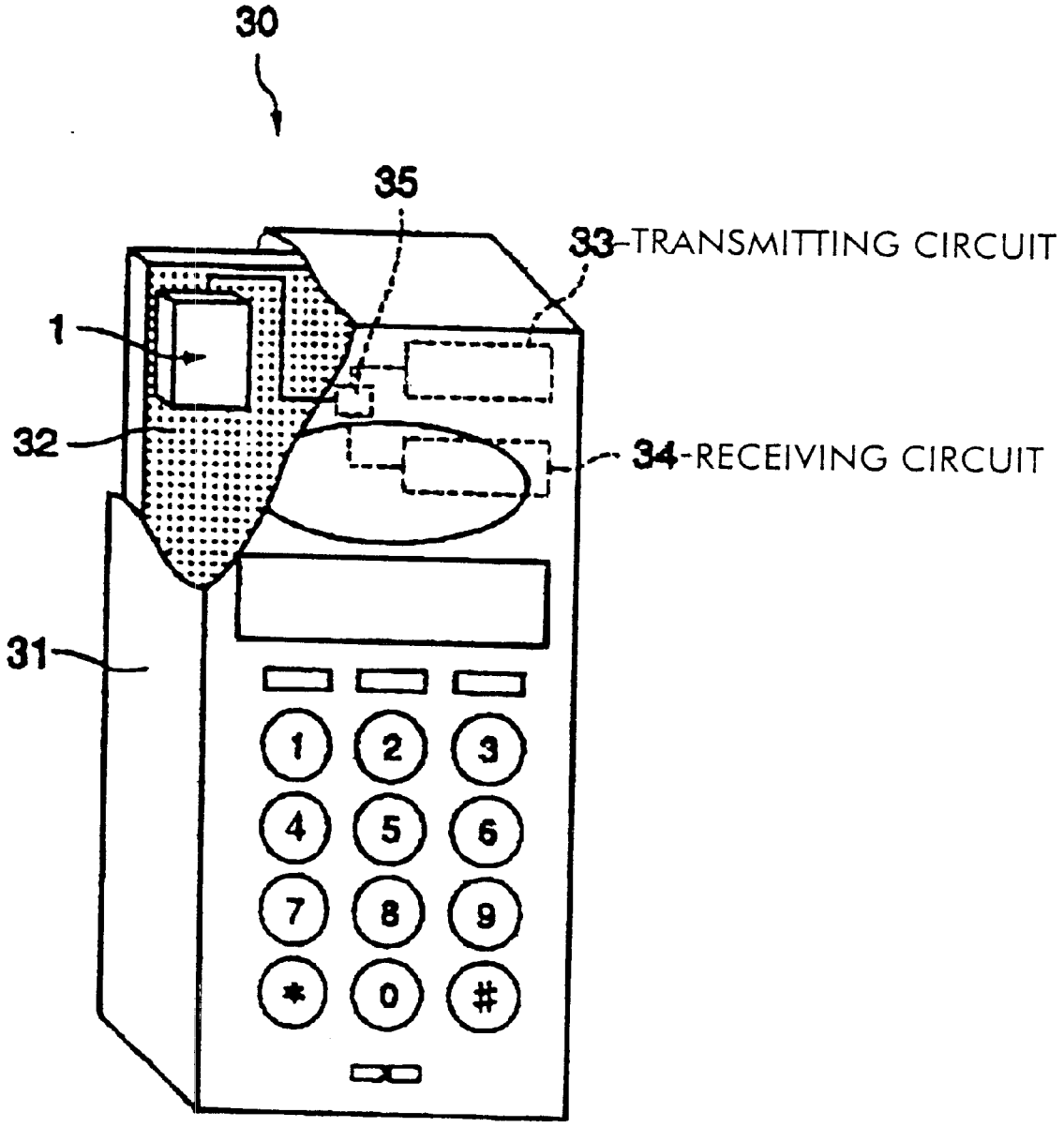
Figure 22A:
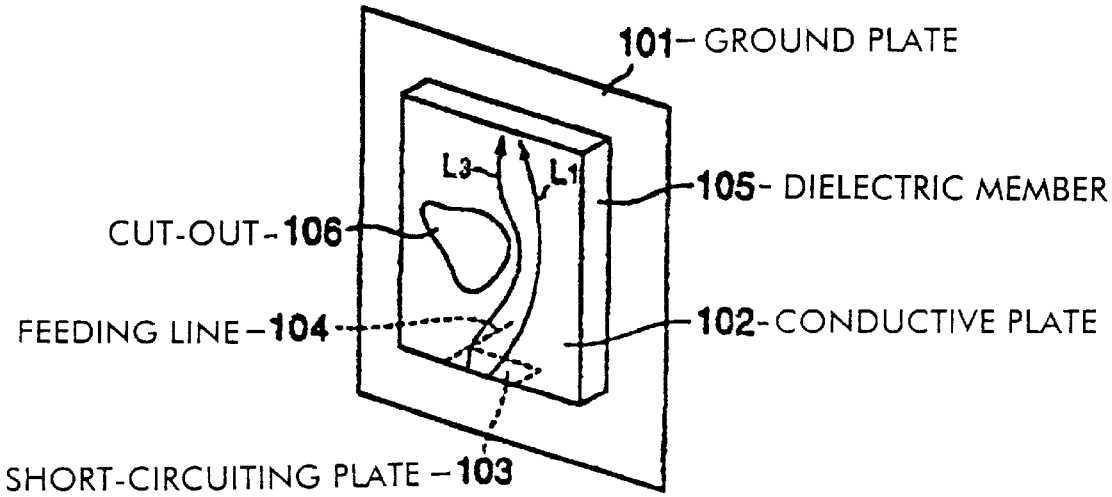
FIG. 22A PRIOR ART
Figure 22B:
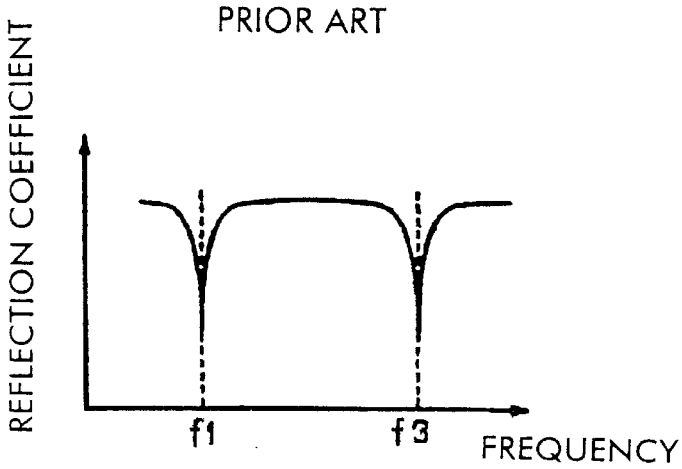
FIG. 22B PRIOR ART

FIG. 9, comprising FIGS. 9A and 9B, illustrates a surface mount antenna according to a second embodiment of the present invention;

FIG. 10, comprising FIG. 10A, and graphs illustrating the dependence of the resonance frequency upon the number of meander lines of a meander pattern formed in a maximum resonance current part in a fundamental mode in a feeding radiation electrode;

FIG. 11, comprising FIGS. 11A and 11B, illustrates a manner of adding a capacitance component in parallel to a current path thereby equivalently forming an inductance component in series in the current path;

FIG. 12, comprising FIGS. 12A, 12B and 12C, illustrates surface mount antennas according to a third embodiment of the present invention;

FIG. 13, comprising FIGS. 13A and 13B, illustrates a surface mount antenna according to a fourth embodiment of the present invention;

FIG. 14 is a schematic diagram illustrating a surface mount antenna according to a fifth embodiment of the present invention;

FIG. 15, comprising FIGS. 15A, 15B, 15C and 15D, illustrates a surface mount antenna according to a sixth embodiment of the present invention;

FIG. 16, comprising FIGS. 16A, 16B, 16C, 16D, illustrate another surface mount antenna according to the sixth embodiment of the present invention;

FIG. 17, comprising FIGS. 17A, 17B, 17C and 17D, illustrates still another surface mount antenna according to the sixth embodiment of the present invention;

FIG. 18, comprising FIGS. 18A, 18B and 18C, illustrate, in the form of graphs, examples of frequency characteristics of the respective surface mount antennas shown in FIGS. 15 to 17;

FIG. 19, comprising FIGS. 19A, 19B and 19C illustrates a surface mount antenna according to a seventh embodiment of the present invention;

FIG. 20, comprising FIGS. 20A and 20B illustrate another surface mount antenna according to the seventh embodiment of the present invention;

FIG. 21 is a schematic diagram illustrating an example of a communication device according to the present invention; and FIG. 22A is a schematic diagram illustrating a conventional technique and FIG. 22B shows the frequency response of the conventional device.

DETAILED DESCRIPTION OF EMBODIMENTS OF THE INVENTION

The present invention is described in further detail below with reference to preferred embodiments in conjunction with the drawings.

Figure 1A:
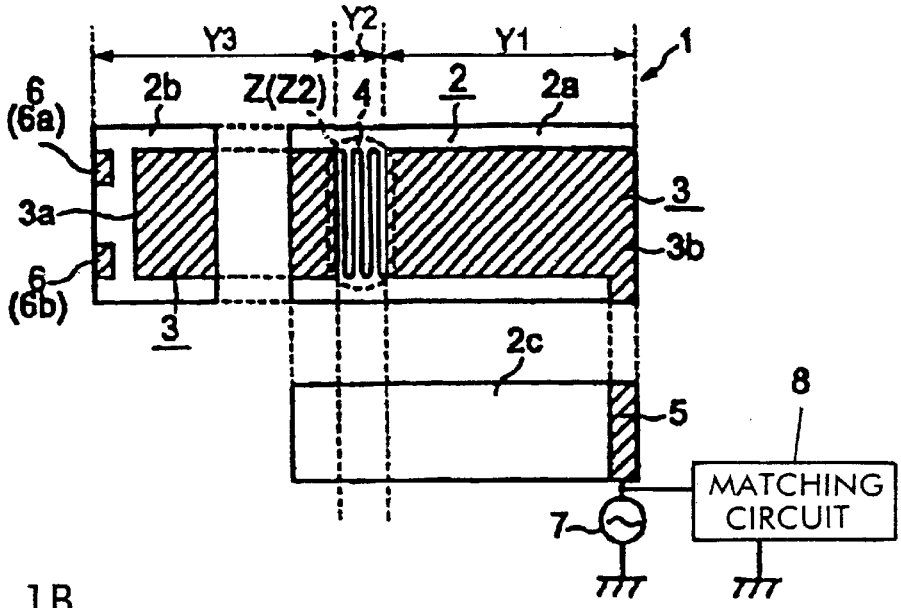

FIG. 1A is a schematic diagram of a surface mount antenna according to a first embodiment of the present invention. This surface mount antenna 1 according to the first embodiment is of a dual-band $\lambda/4$-resonance antenna of the direct excitation type which is designed to be mounted in a non-ground area and which is capable of transmitting and receiving signals in two frequency bands corresponding to the fundamental mode and the high-order mode (second-order mode in this first embodiment). The surface mount antenna 1 includes a feeding radiation electrode 3 formed on the surface of a dielectric substrate 2 in the form of a rectangular parallelepiped. In FIG. 1A, the upper surface 2*a* and side faces 2*b* and 2*c* are shown in the form of a development.

As shown in FIG. 1A, the feeding radiation electrode 3 is formed into the shape of a stripe extending from the upper surface 2*a* to the side face 2*b* of the dielectric substrate 2. A meander pattern 4, which characterizes the first embodiment, is formed locally in the feeding radiation electrode 3. An end 3*a*, on the left side of FIG. 1A, of the feeding radiation electrode 3 is formed to be electrically open and the end 3*b* on the right side is electrically connected to a feeding terminal 5 which extends from the right end 3*b* of the feeding radiation electrode 3 onto the side face 2*c* and further onto the bottom surface.

On the side face 2*b* of the dielectric substrate 2, fixed ground electrodes 6 (6*a*, 6*b*) are formed at locations spaced by gaps from the open end 3*a* of the feeding radiation electrode 3.

In practical applications, the surface mount antenna 1 is mounted on a circuit board of a communication device such that the bottom surface (not shown), opposite to the upper surface 2*a* of the dielectric substrate 2, is in contact with the circuit substrate. Note that this surface mount antenna 1 is designed to be mounted in a non-ground area of a circuit board of a communication device.

A signal source 7 and a matching circuit 8 are formed on the circuit board of the communication device such that when the surface mount antenna 1 is mounted on the circuit board, the feeding terminal 5 of the surface mount antenna 1 is electrically connected to the signal source 7 via the matching circuit 8. Instead of forming the matching circuit 8 on the circuit board of the communication device, the matching circuit 8 may be formed as a part of the electrode pattern on the surface of the dielectric substrate 2.

If a signal is supplied from the signal source 7 via the matching circuit 8 to the feeding terminal 5 of the surface mount antenna 1 mounted on the circuit board, the signal is supplied from the feeding terminal 5 directly to the feeding radiation electrode 3. The supply of the signal causes a current to flow from the right end 3*b* of the feeding radiation electrode 3 to the open end 3*a* via the meander pattern 4. As a result, resonance occurs on the feeding radiation electrode 3 and the signal is transmitted/received.

Figure 1B:
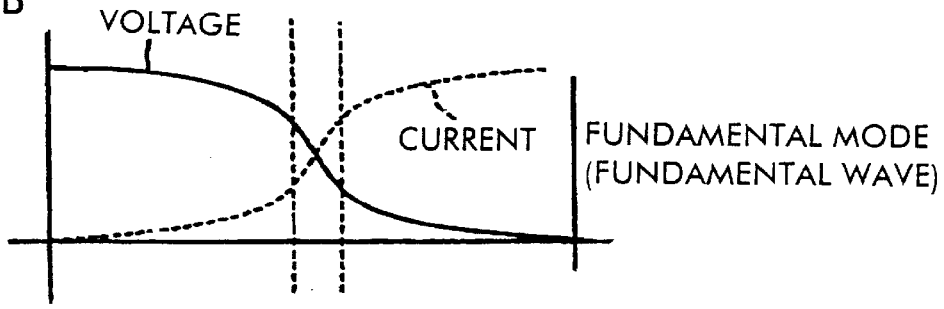
Figure 1C:
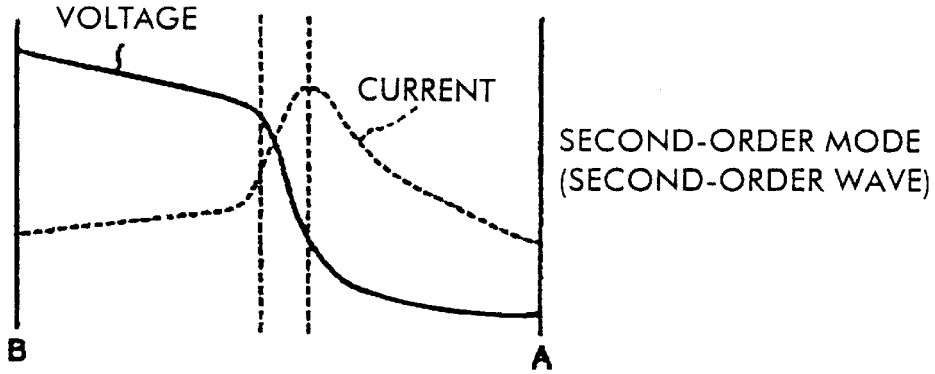
Figure 1D:
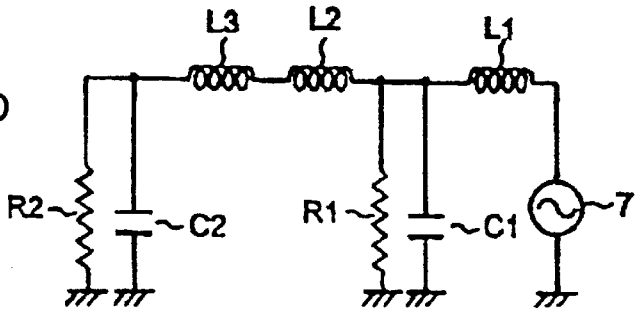
Figure 2:
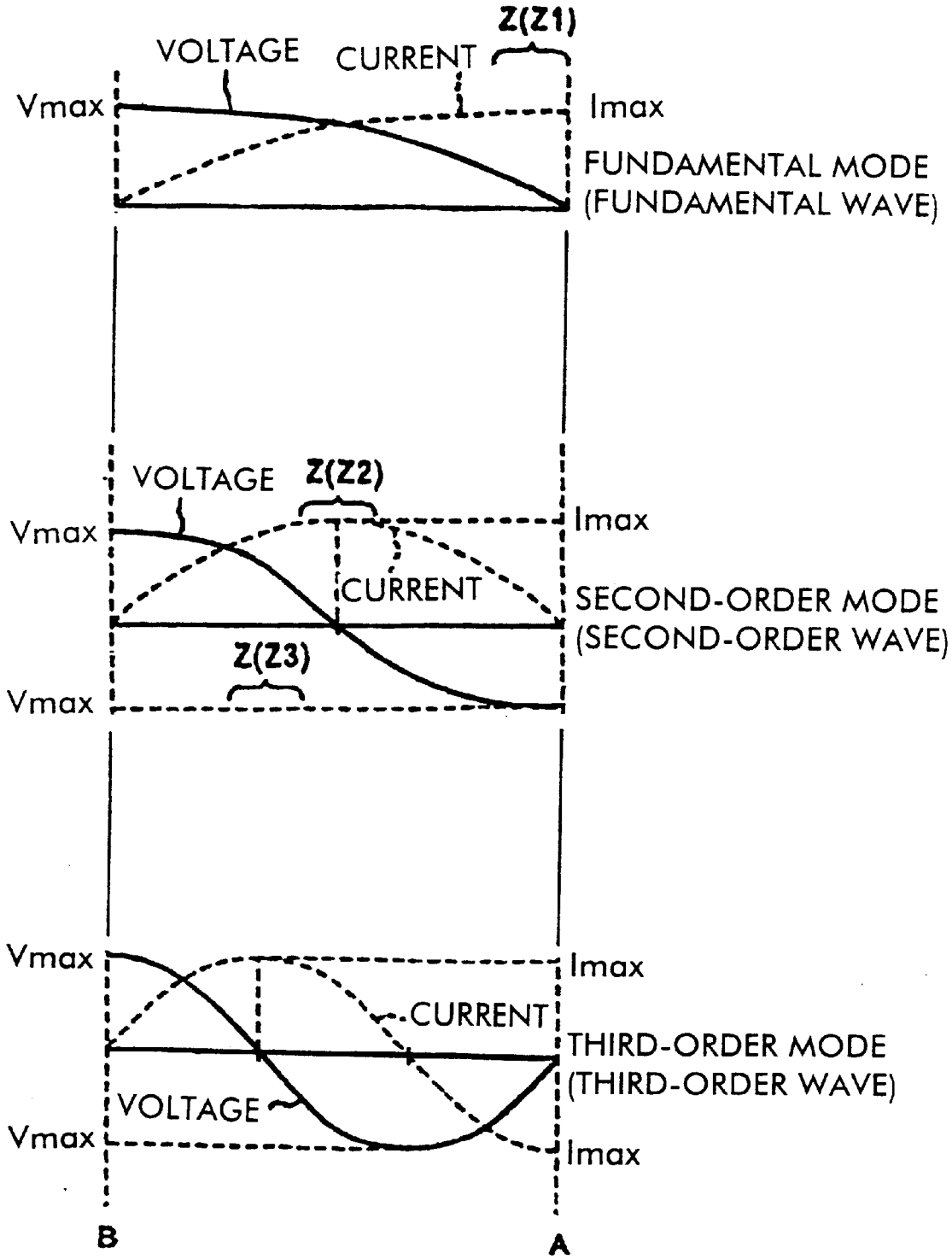

In FIG. 2, typical current distributions across the feeding radiation electrode 3 are represented by broken lines and voltage distributions are represented by solid lines, for respective modes. In FIG. 2, an end A corresponds to the end, on the signal source side, of the feeding radiation electrode 3 (corresponding to the right end 3*b* of the feeding radiation electrode 3 of the surface mount antenna 1 in the specific example shown in FIG. 1), and an end B corresponds to the other end of the feeding radiation electrode 3 (corresponding to the open end 3*a* of the feeding radiation electrode 3 of the surface mount antenna 1 in the specific example shown in FIG. 1).

As shown in FIG. 2, each mode has its own unique current and voltage distributions. For example, in the fundamental mode, a maximum resonance current part Z (Z1) including a maximum current point Imax at which the resonance current has a maximum value is formed on the side where the right end 3*b* of the feeding radiation electrode 3 is located. In contrast, in the second-order mode which is one of high-order modes, a maximum resonance current part Z (Z2) including a maximum current point Imax at which the resonance current has a maximum value is formed at a substantially central point of the feeding radiation electrode 3. That is, the location, on the feeding radiation electrode 3, where the maximum resonance current part Z is formed is different for each mode.

The present invention is based on an idea of the inventors of the present invention that if an inductive component is locally added in series in one of or both of the maximum resonance current parts Z in the fundamental mode and the high-order modes (second-order and third-order modes) so that the electrical length per unit physical length in the maximum resonance current parts Z becomes longer than in the other parts, great changes occur in the current and voltage distributions in each mode compared relative to those obtained before adding the series inductive component and thus the difference in resonance frequency between the fundamental mode and the high-order modes becomes very great and that the difference can be controlled.

In this first embodiment, in view of the above, the meander pattern 4 is formed locally in the maximum resonance current part Z (Z2) in the second-order mode in the feeding radiation electrode 3 so as to locally add a series inductance component in the maximum resonance current part Z in the order-order mode. Thus, in this first embodiment, the maximum resonance current part Z (Z2) of the feeding radiation electrode 3 has a greater electrical length per unit physical length than the other parts. As a result, the feeding radiation electrode 3 has a structure in which a part Y1 with a small electrical length, a part Y2 with a large electrical length, and a part Y3 with a small electrical length are disposed in series in this order from the signal source side (feeding electrode 5). An equivalent circuit of the feeding radiation electrode 3 is shown in FIG. 1D. In FIG. 1D, L1 represents an inductance component in the part Y1 with the small electrical length and L2 represents the series inductance component locally added by the meander pattern 4, wherein the series inductance component L2 is greater than the inductance component L1. L3 represents an inductance component in the part Y3 with the small electrical length, wherein the inductance component L3 is smaller than the series inductance component L2. C1 and C2 represent capacitance between the feeding radiation electrode 3 and ground, and R1 and R2 represent conduction resistance components of the feeding radiation electrode 3.

The formation of the meander pattern 4 in the maximum resonance current part Z in the second-order mode in the feeding radiation electrode 3 results in large changes in the current and voltage distributions in the second-order mode as shown in FIGS. 1B and 1C. That is, it is possible to vary the difference between the resonance frequency in the fundamental mode and the resonance frequency in the high-order mode by forming the meander pattern 4. FIG. 1B illustrates the current and voltage distributions in the fundamental mode obtained after forming the above-described meander pattern 4 in the maximum resonance current part Z (Z2) in the second order mode. As can be seen in FIG. 1B, the formation of the meander pattern 4 in the maximum resonance current part Z in the second-order mode does not have a significant influence upon the current and voltage distributions in the fundamental mode.

By modifying the series inductance component of the meander pattern 4, it is possible to change only the resonance frequency f2 substantially independently of the resonance frequency f1 in the fundamental mode. This has been experimentally confirmed by the inventors of the present invention as described below.

Figure 3A:
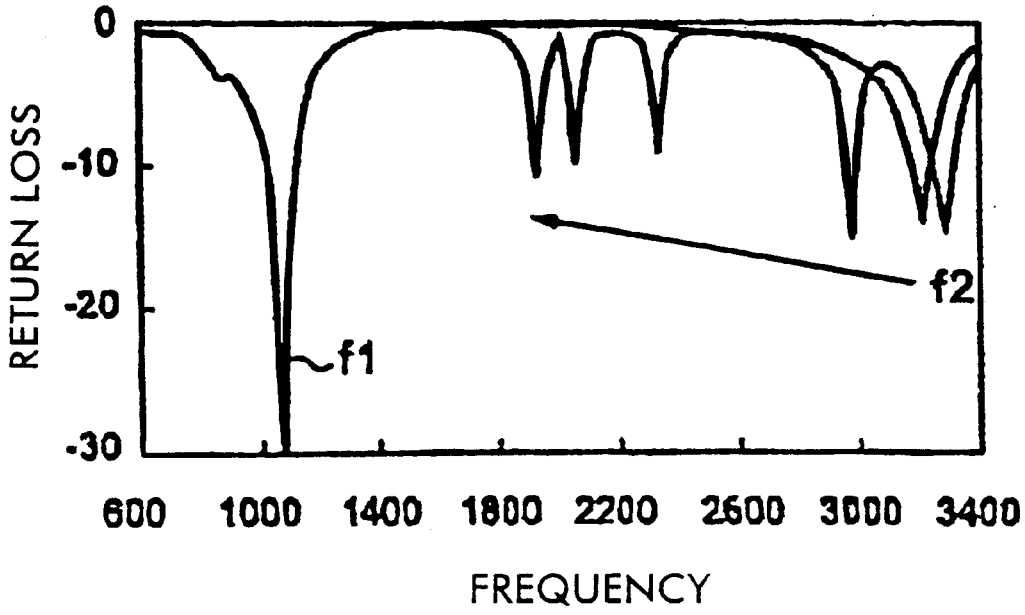
Figure 3B:
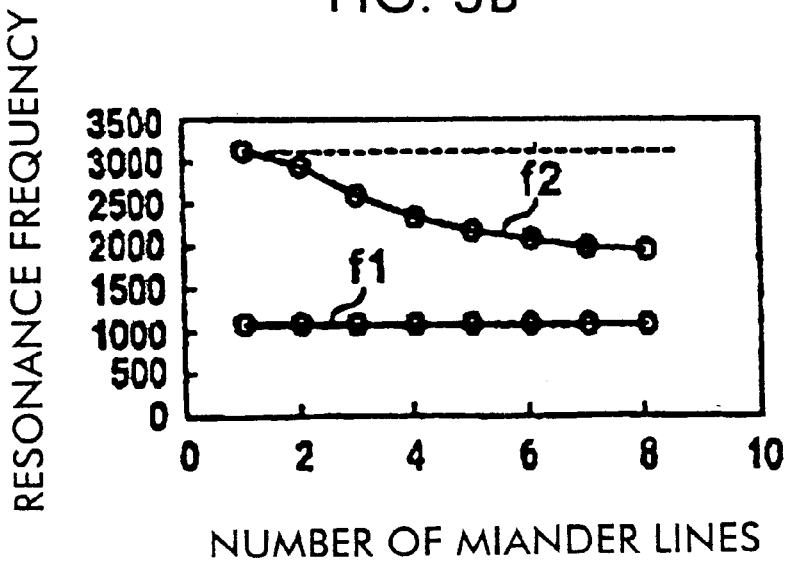

That is, the inductance of the meander pattern 4 was varied by varying the number of meander lines of the meander pattern 4, and the dependence of the resonance frequency f1 in the fundamental mode and the resonance frequency f2 in the second-order mode upon the number of meander lines was investigated. The results are shown in FIGS. 3A and 3B. As can be seen, the resonance frequency f2 in the second-order mode decreases greatly with increasing number of meander lines of the meander pattern 4 and thus with increasing inductance of the meander pattern 4. In other words, the resonance frequency f2 in the second-order mode increases with decreasing inductance of the meander pattern 4.

In contrast, the change in the number of meander lines of the meander pattern 4 (change in the inductance of the meander pattern 4) results in substantially no change in the resonance frequency f1 in the fundamental mode.

As described above with reference to the experimental results, if the series inductance component is added by locally forming the meander pattern 4 in the maximum resonance current part Z (Z2) in the second-order mode in the feeding radiation electrode 3, it becomes possible to vary only the resonance frequency f2 in the high-order mode (second-order mode) without changing the resonance frequency f1 in the fundamental mode so as to set the resonance frequency f2 to a desired value, by adjusting the inductance of the meander pattern 4.

Figure 4:
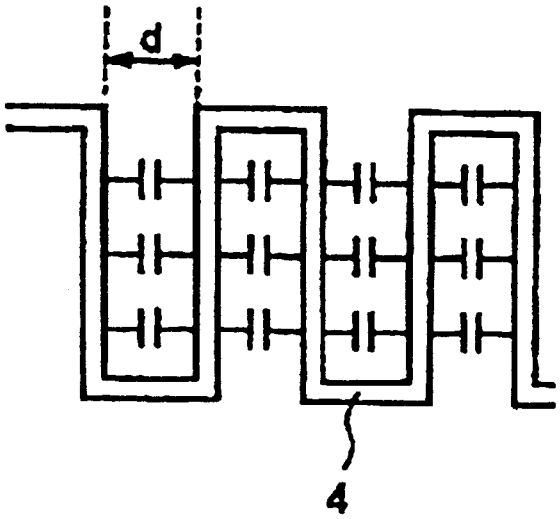
FIG. 4 is schematic diagram illustrating capacitance between meander lines of a meander pattern.
Figure 5:
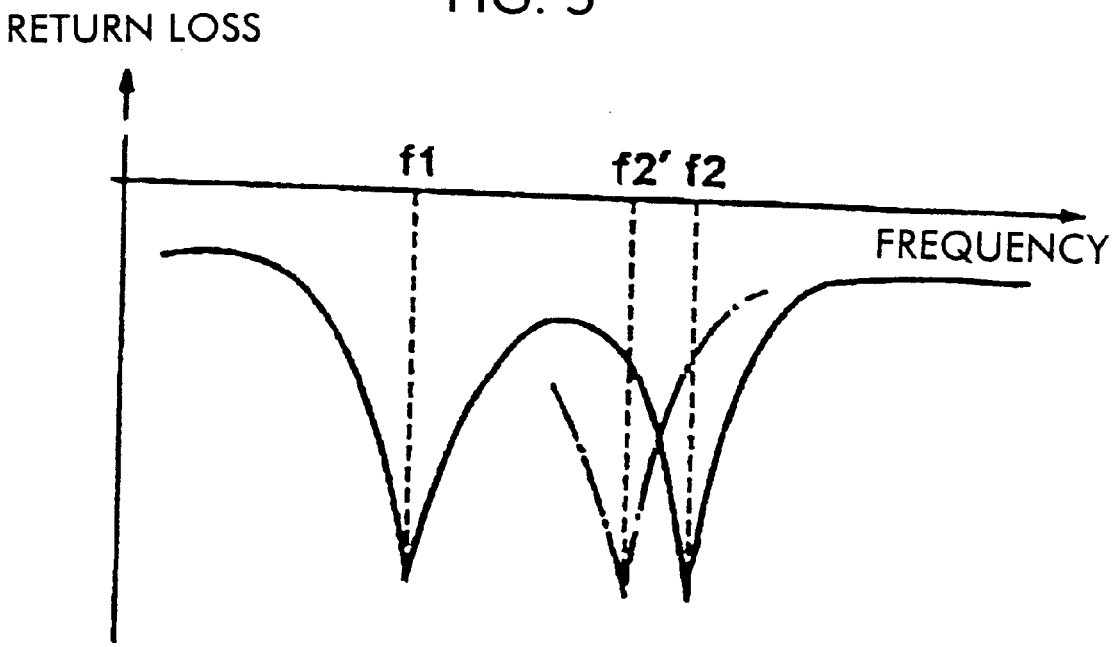
FIG. 5 is a graph illustrating an example of the frequency characteristic of a surface mount antenna.

Instead of changing the number of meander lines to change the inductance of the meander pattern 4 as described above, the inductance of the meander pattern 4 may be changed by changing the meander pitch d of the meander pattern 4 such as that shown in FIG. 4 thereby changing the capacitance between meander lines. The inductance of the meander pattern 4 may also be adjusted by changing the width of the meander lines of the meander pattern 4.

In the first embodiment, the surface mount antenna 1 is formed in the above-described manner. Therefore, at the design stage of the surface mount antenna 1, the resonance frequency in the fundamental mode can be set to a desired value by setting the length between the right end 3*b* and the open end 3*a* of the feeding radiation electrode 3 to be equal to one-quarter the effective wavelength 1 in the fundamental mode. As for the second-order mode, the resonance frequency can be set to a desired value as follows. First, the series inductance component of the meander pattern 4 is calculated which is to be formed in the maximum resonance current part Z (Z2) in the second-order mode to obtain the desired resonance frequency in the second-order mode. Thereafter, the number of meander lines or the meander pitch d of the meander pattern 4 is determined so as to obtain the series inductance component.

In this first embodiment, as described above, the meander pattern 4 is formed locally in the maximum resonance current part Z (Z2) in the second-order mode in the feeding radiation electrode 3. This makes it possible to locally add a series inductance component to the maximum resonance current part Z (Z2) in the second-order mode so that the electric length in that part becomes greater than in the other parts. Thus, it becomes possible to vary the resonance frequencies in the fundamental mode and the high-order modes so as to adjust them to desired values.

Furthermore, in this first embodiment in which the series inductance component is locally added using the meander pattern 4 as described above, it is possible to vary the series inductance component by varying the number of meander lines or the width of the meander lines of the meander pattern 4. Therefore, it is possible to easily increase the electrical length in the maximum resonance current part Z (Z2) in the second-order mode simply by redesigning the meander pattern 4 so as to adjust the resonance frequency f2 in the second-order mode.

The adjustment of the resonance frequency f2 in the second-order mode by means of changing the series inductance component (electrical length) can be performed independently of the resonance frequency in the fundamental mode. Therefore, the resonance frequency f2 in the second-order mode can be adjusted without concern for the influence of the series inductance component upon the fundamental mode. Because the series inductance component can be varied over a very large range, the resonance frequency f2 in the second-order mode can be set to a value in a very large range. Thus, the degree of freedom for the design of the surface mount antenna 1 having a frequency characteristic suitable for use in multi-band applications is expanded, and it becomes possible to efficiently produce such a surface mount antenna 1. Besides, a reduction in cost of the surface mount antenna 1 is achieved.

In contrast, in the conventional technique shown in FIG. 22, as described earlier, the reduction in the size of the antenna is limited by the large cut-out 106 which is formed in the conductive plate 102 to adjust the electrical length in the high-order mode thereby adjusting the resonance frequency in the high-order mode.

In contrast, in the first embodiment in which the resonance frequency in the high-order mode is adjusted by locally forming the meander pattern 4 so as to locally form the series inductance component, the meander pattern 4 can be formed in a very small area, and thus the surface mount antenna 1 can be realized without causing a significant increase in the size.

In the first embodiment described above, the resonance frequency f2 in the second-order mode can be easily controlled by adjusting the series inductance component realized by the meander pattern 4, and thus the resonance frequency f2 can be precisely set to a desired value. Thus, the resultant surface mount antenna 1 is excellent in performance and reliability.

In the case where the resonance frequency f2 in the second-order mode deviates from a desired value f2' to a higher value due to a limitation in fabrication accuracy as represented by the second-order mode can be reduced to the desired value f2' by reducing the width of the meander pattern 4 by means of trimming thereby increasing the inductance component of the meander pattern 4.

In the above adjustment of the frequency by means of trimming, the change in the inductance component of the meander pattern 4 resulting from the trimming does not substantially influence the fundamental mode. That is, the present embodiment has a great advantage that only the resonance frequency f2 in the second-order mode can be adjusted without substantially changing the resonance frequency f1 in the fundamental mode.

When both resonance frequencies f1 and f2 in the fundamental mode and the second-order mode are deviated to lower values from the desired values, if the open end 3*a* of the feeding radiation electrode 3 is trimmed so as to reduce the capacitance between the open end 3*a* and ground, the resonance frequencies f1 and f2 in the fundamental mode and the second-order mode are increased by a substantially equal amount ($\Delta f$).

Figure 6:
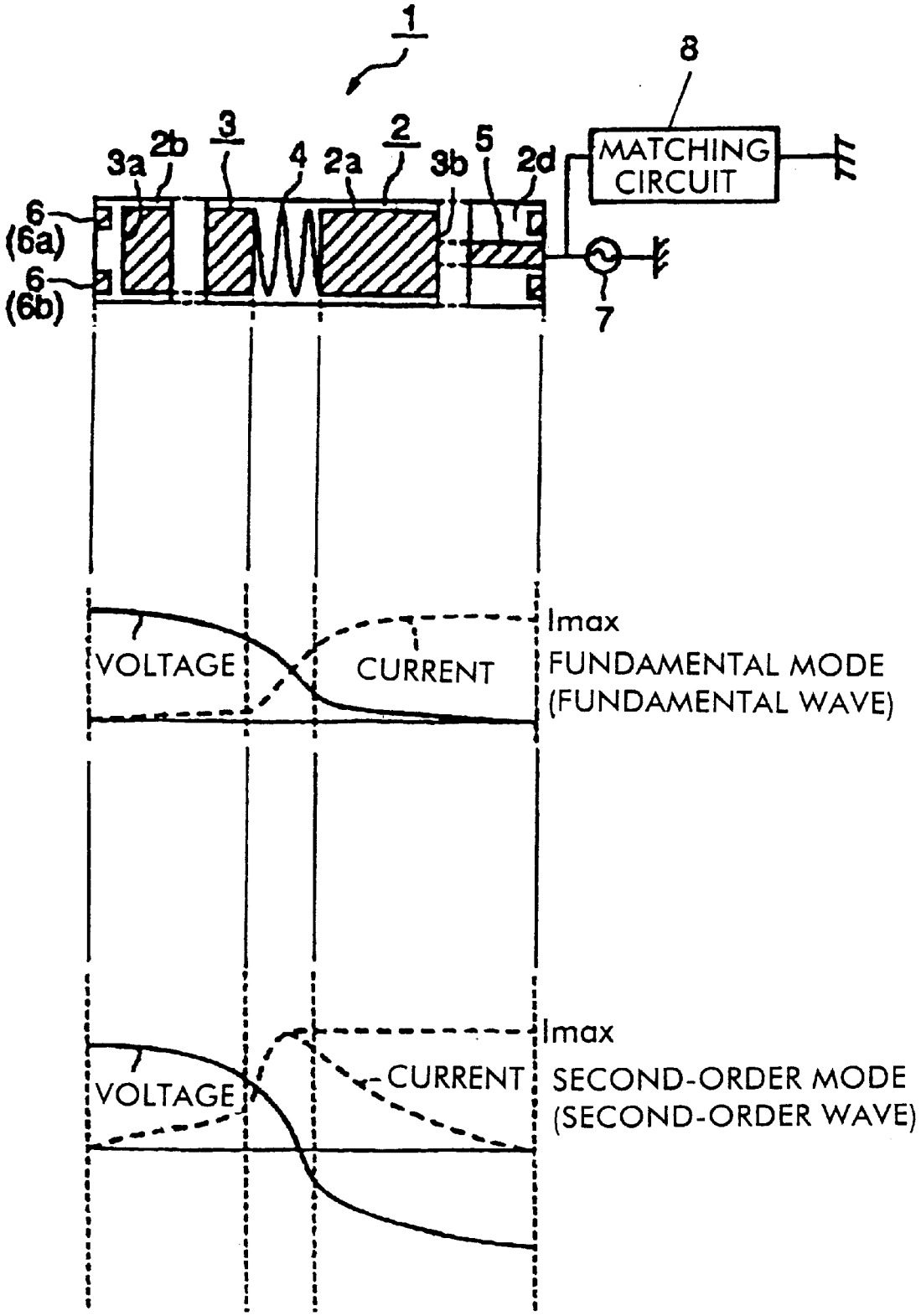
FIG. 6 is a schematic diagram illustrating an example of a surface mount antenna of the 1/4-resonance direct-excitation type designed to be mounted in a ground area, constructed according to the first embodiment.
Figure 7:
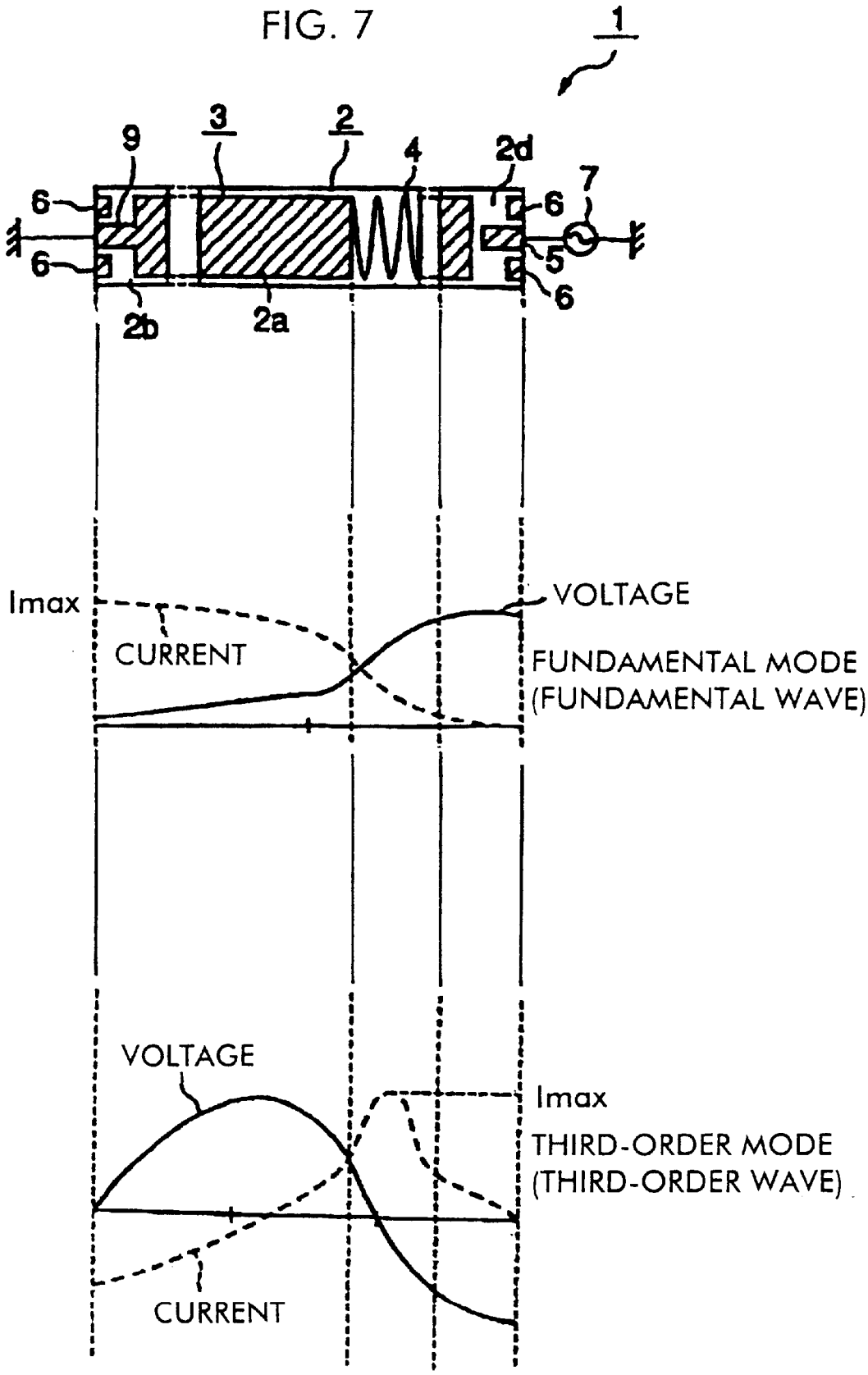
FIG. 7 is a schematic diagram illustrating an example of a surface mount antenna of the 1/4-resonance capacitively-exciting type designed to be mounted in a ground area, constructed according to the first embodiment.
Figure 8:
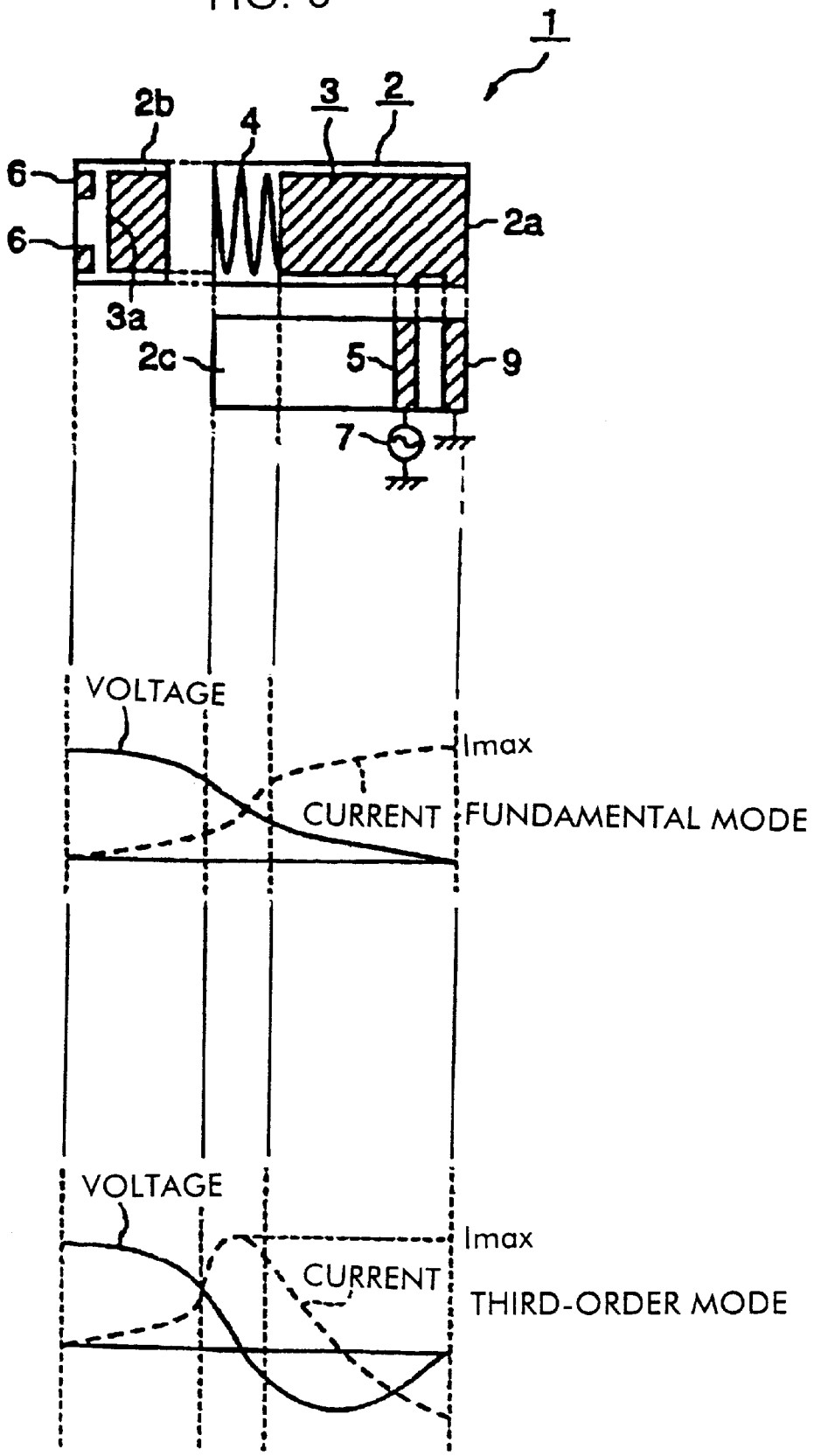
FIG. 8 is a schematic diagram illustrating an example of a surface mount antenna of the inverted F type, constructed according to the first embodiment.

Although the first embodiment has been described above with reference to the $\lambda/4$-resonance antenna of the direct excitation type which is designed to be mounted in a non-ground area, a similar structure according to the present embodiment may also be formed in other types of dual-band surface mount antennas. FIG. 6 illustrates an example of a $\lambda/4$-resonance antenna of the direct excitation type which is designed to be mounted in a ground area, and FIG. 7 illustrates an example of a $\lambda/4$-resonance antenna 1 of the capacitively exciting type. FIG. 8 illustrates an example of a surface mount antenna 1 of the inverted F type, wherein current and voltage distributions in the respective modes are also shown. In FIGS. 6 to 8, similar parts to those in the surface mount antenna 1 shown in FIG. 1 are denoted by similar reference numerals, and they are not described in further detail herein.

Like the surface mount antenna 1 shown in FIG. 1, the surface mount antenna 1 shown in FIG. 6 is capable of transmitting and receiving radio waves in two different frequency bands in the fundamental mode and the second-order mode (high-order mode). The surface mount antennas 1 shown in FIGS. 7 and 8 are capable of transmitting and receiving radio waves in two different frequency bands in the fundamental mode and the third-order mode (high-order mode).

In the surface mount antenna 1 shown in FIG. 6, a meander pattern 4 is locally formed in a maximum resonance current part Z in the second-order mode in a feeding radiation electrode 3 so that a series inductance component is locally added in the maximum resonance current part Z in the second-order mode. On the other hand, in each of the surface mount antennas 1 shown in FIGS. 7 and 8, a meander pattern 4 is locally formed in a maximum resonance current part Z in the third-order mode in a feeding radiation electrode 3 so that a series inductance component is locally added in the maximum resonance current part Z in the third-order mode. In the surface mount antennas 1 shown in FIG. 7 and 8, a ground terminal 9 is formed on an end, opposite to an open end, of the feeding radiation electrode 3.

Also in those surface mount antennas 1 shown in FIGS. 6 to 8, a similar structure employed in the surface mount antenna 1 shown in FIG. 1 may be formed so as to achieve great advantages similar to those obtained in the surface mount antenna 1 shown in FIG. 1.

A second embodiment is described below. The second embodiment is characterized in that, in addition to the structure according to the first embodiment, a meander pattern 10 is formed in a maximum resonance current part Z (Z1) in the fundamental mode in a feeding radiation electrode 3 as shown in FIG. 9A. Except for the above, the second embodiment is similar in structure to the first embodiment. Therefore, in this second embodiment, similar parts to those of the first embodiment are denoted by similar reference numerals and duplicated descriptions of them are not given herein.

In this second embodiment, as described above, a meander pattern is formed not only in the maximum resonance current part Z (Z2) in the second-order mode in the feeding radiation electrode 3 but also in the maximum current part Z (Z1) in the fundamental mode. As a result, series inductance components are locally added in the respective maximum resonance current parts Z in the fundamental mode and the second-order mode in the feeding radiation electrode 3, whereby the electrical length per unit physical length in these maximum resonance current parts Z becomes greater than in the other parts. That is, in the second embodiment, the feeding radiation electrode 3 includes a series of parts X1, X2, X3, and X4 disposed in this order from the signal source side wherein the electrical length is large in the parts X1 and X3 but short in the parts X2 and X4.

FIG. 9B illustrates an equivalent circuit of the feeding radiation electrode 3 of the second embodiment. In FIG. 9B, L1 represents the series inductance component locally added in the maximum resonance current part Z1 in the fundamental mode by the meander pattern 10. L2 represents an inductance component in the part X2 having the small electrical length, wherein the inductance component L2 is smaller than the inductance component L1. L3 represents the series inductance component locally added in the maximum resonance current part Z2 in the second-order mode by the meander pattern 4, wherein the inductance component L3 is greater than the inductance component L2. L4 represents an inductance component in the part X4 having the small electrical length, wherein the inductance component L4 is smaller than the inductance component L3. C1 and C2 represent capacitance between the feeding radiation electrode 3 and ground, and R1 and R2 represent conduction resistance components of the feeding radiation electrode 3.

Forming the feeding radiation electrode 3 in the above-described manner makes it possible to adjust the resonance frequencies in the fundamental mode and the high-order mode in a more advanced fashion. That is, it is possible to easily adjust not only the resonance frequency f2 in the second-order mode but also the resonance frequency f1 in the fundamental mode.

The inventors of the present invention have experimentally investigated the dependence of the inductance component provided by the meander pattern 10 upon the resonance frequency f1 in the fundamental mode by varying the number of meander lines of the meander pattern 10 thereby varying the inductance component. The results are shown in FIGS. 10A and 10B.

Figure 10B:
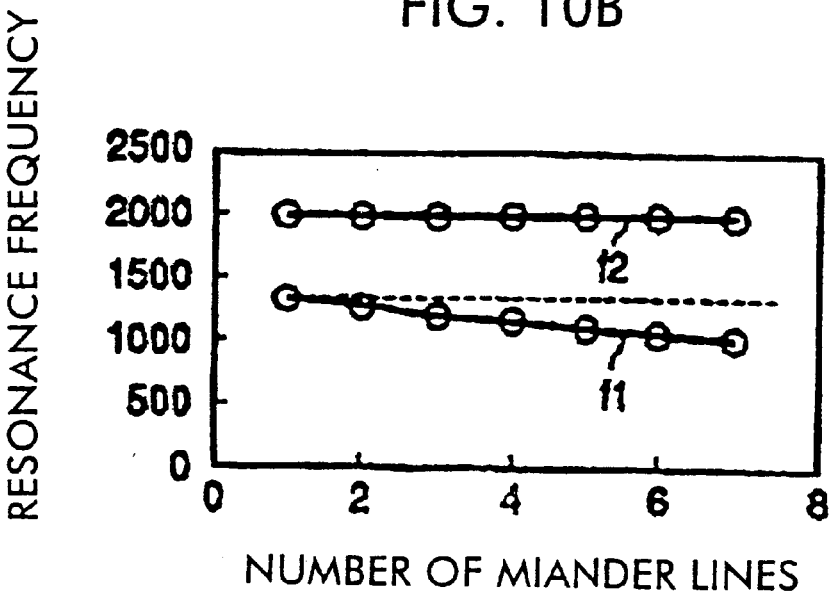

As can be seen from FIGS. 10A and 10B, the resonance frequency f1 in the fundamental mode decreases with increasing number of meander lines of the meander pattern 10 and thus with increasing series inductance component. In other words, the resonance frequency f1 in the fundamental mode increases with decreasing number of meander lines of the meander pattern 10 and thus with decreasing series inductance component. However, the resonance frequency f2 in the second-order mode is held substantially constant when the number of meander lines of the meander pattern 10 is varied.

Therefore, by varying the series inductance component locally added in the maximum resonance current part Z (Z1) in the fundamental mode in the meander pattern 10, the resonance frequency f1 in the fundamental mode can be adjusted independently of the resonance frequency f2 in the second-order mode. Of course, instead of varying the number of meander lines of the meander pattern 10, the meander pitch d or the width of the meander lines of the meander pattern 10 may be varied to vary the equivalent series inductance component of the meander pattern 10 thereby adjusting the resonance frequency f1 in the fundamental mode.

In the second embodiment, as described above, in addition to the meander pattern 4 providing the series inductance component locally in the maximum resonance current part Z (Z2) in the second-order mode, the meander pattern 10 is formed to provide the series inductance component locally in the maximum resonance current part Z (Z1) in the fundamental mode so that the electrical length in the respective maximum resonance current parts Z in the fundamental mode and the high-order mode becomes greater than in the other parts, thereby making it possible to adjust the respective resonance frequencies in the fundamental mode and the high-order mode over wider ranges.

At the design stage, the respective resonance frequencies f1 and f2 in the fundamental mode and the high-order mode can be determined simply by determining the meander patterns 4 and 10 without needing additional great changes in the design. The resonance frequencies f1 in the fundamental mode and the resonance frequency f2 in the second-order mode can be precisely controlled independently of each other. This provides an increase in the degree of freedom for the design of the multi-band antenna. That is, the respective resonance frequencies f1 and f2 can be easily set and adjusted precisely to desired values. Thus, the resultant surface mount antenna 1 is excellent in performance and reliability.

The above-described technique of adjusting the respective resonance frequencies f1 and f2 in the fundamental mode and the high-order mode by means of adjusting the series inductance components of the meander patterns 4 and 10 allows expansion of the ranges within which the respective resonance frequencies f1 and f2 can be set.

Thus, it becomes possible to more easily and efficiently provide a surface mount antenna 1 which satisfies the requirements needed in the multi-band applications, and a reduction in cost of the surface mount antenna 1 can be achieved. The meander pattern 4 can be formed in very small areas, and thus the surface mount antenna 1 can be realized in a form with a small size.

Also in this second embodiment, when the surface mount antenna 1 has deviations of the resonance frequencies f1 and f2 in the fundamental mode and the second-order mode from desired values due to a limitation in fabrication accuracy, the resonance frequencies in the fundamental mode and the second-order mode can be adjusted independently to the desired values by adjusting the inductance components of the meander patterns 4 and 10 by means of trimming in a similar manner as described in the first embodiment. This makes it possible to achieve higher performance and reliability in the surface mount antenna 1.

Although the second embodiment has been described above with reference to the surface mount antenna 1 shown in FIG. 9, the structure characterizing the second embodiment may be formed in any of the surface mount antennas 1 shown in FIGS. 6 to 8 (that is, a meander pattern 10 may be formed locally in the maximum resonance current part Z (Z1) in the fundamental mode (in the part on the signal source side of the feeding radiation electrode 3) so as to obtain great advantages similar to those described above.

Now, a third embodiment is described below. In this third embodiment, similar parts to those of the previous embodiments are denoted by similar reference numeral and duplicated descriptions of them are not given herein.

If capacitance components C is disposed in parallel to a current path (transmission line) 12 as shown in FIG. 11A, this parallel capacitance component can act as an equivalent series inductance component L which looks as if it were actually present.

This is utilized in the third embodiment to locally form an equivalent series inductance component in one of or both of the maximum resonance current parts in the fundamental mode and the high-order mode. Specific examples of surface mount antennas 1 having such a structure are shown in FIGS. 12A, 12B, and 12C.

In each of the surface mount antennas 1 shown in FIGS. 12A, 12B, and 12C, an equivalent series inductance component is locally added in a maximum resonance current part Z (Z2) in the second-order mode. In the example shown in FIG. 12A, a side end of the strip-shaped feeding radiation electrode 3 is partially cut out so as to form a cut-out portion 13 in a maximum resonance current part Z (Z2) in the second-order mode, and a parallel capacitance electrode 14 is disposed in the cut-out part such that the parallel capacitance electrode 14 is spaced from the feeding radiation electrode 3 by a gap, thereby forming a parallel capacitance component C between the parallel capacitance electrode 14 and the cut-out portion 13 in the maximum resonance current part Z (Z2) in the second-order mode. As a result, equivalently, a series inductance component is added in the maximum resonance current part Z (22) in the second-order mode.

In the example shown in FIG. 12B, in addition to the structure according to the first embodiment described above with reference to FIG. 1, a parallel capacitance electrode 14 is disposed close to but spaced by a gap from corners of a meander pattern 4. Also in this structure, as in the structure shown in FIG. 12A, a parallel capacitance component C is formed in a maximum resonance current part Z (Z2) in the second-order mode in the meander pattern 4. Thus, in this example shown in FIG. 12B, the sum of the series inductance component provided by the meander pattern 4 and the equivalent series inductance component provided by the capacitance component C between the meander pattern 4 and the parallel capacitance electrode 14 is formed in the maximum resonance current part Z (Z2) in the second-order mode.

On the other hand, in the example shown in FIG. 12C, in addition to the structure according to the first embodiment described above with reference to FIG. 1, a parallel capacitance electrode 14 in the form of a comb is disposed close to a meander pattern 4 such that they are interdigitally coupled with each other via a gap. Also in this case, as in the structure shown in FIG. 12B, a parallel capacitance component C is formed in a maximum resonance current part Z (Z2) in the second-order mode in the meander pattern 4. As a result, the sum of a series inductance component provided by the meander pattern 4 and the equivalent series inductance component provided by the capacitance component C between the meander pattern 4 and the parallel capacitance electrode 14 is formed in the maximum resonance current part Z (Z2) in the second-order mode.

The structure employed to equivalently form a series inductance component using a parallel capacitance component is not limited to those shown in FIGS. 12A to 12C. For example, instead of forming the parallel capacitance component C in the maximum resonance current part Z in the high-order mode, a similar structure may be formed in the maximum resonance current part Z (Z1) in the fundamental mode so as to equivalently form a series inductance component using a parallel capacitance component C.

Furthermore, similar structures may be formed in the respective maximum resonance current parts Z in the fundamental mode and the high-order mode so as to equivalently form local series inductance components using parallel capacitance components C. In any of the structures shown in FIGS. 12A to 12C, a meander pattern similar to the meander pattern 10 employed in the second embodiment may be further formed in the maximum resonance current part Z (Z1) in the fundamental mode.

Although the specific examples shown in FIGS. 12A to 12C are λ/4-resonance antennas of the direct excitation type which are designed to be mounted in a non-ground area, a similar structure according to the third embodiment may also be formed in other types of surface mount antennas such as a λ/4-resonance antenna of the capacitively exciting type which is designed to be mounted in a non-ground area, a λ/4-resonance antenna of the direct excitation type which is designed to be mounted in a ground area, a λ/4-resonance antenna of the capacitively exciting type which is designed to be mounted in a ground area, and a surface mount antenna in the inverted F type, so as to obtain great advantages similar to those described above.

In the third embodiment, as described above, utilizing the fact that a series inductance component can be equivalently added in a current path by forming a capacitance component C in parallel to the current path, a series inductance component is locally added in one of or both of maximum resonance current parts in the fundamental mode and the high-order mode. Thus, the third embodiment constructed in the above-described manner provides great advantages, as in the previous embodiments, that the difference between the frequency in the fundamental mode and the frequency in the high-order mode can be varied, the respective resonance frequencies f1 and f2 in the fundamental mode and the high-order mode can be easily controlled, the degree of freedom for the design of the multi-band antenna is increased, the surface mount antenna 1 which satisfies the requirements needed in the multi-band applications can be produced in an easy and efficient manner, and reductions in size and cost of the surface mount antenna 1 can be achieved.

The value of the equivalent series inductance component can be varied by varying the value of the parallel capacitance component C. Therefore, when there is a deviation of the resonance frequency in the fundamental mode or the high-order mode from the desired value, due to a limitation in the fabrication accuracy, the resonance frequency can be adjusted by varying the value of the equivalent series inductance component provided by the parallel capacitance component C by means of, for example, trimming the parallel capacitance electrode 14.

A fourth embodiment is described below. In this fourth embodiment, similar parts to those of the previous embodiments are denoted by similar reference numerals and duplicated descriptions of them are not given herein.

The fourth embodiment is characterized in that a dielectric substrate 2 is made of plural pieces of dielectric connected into a single piece such that a piece of dielectric with a large dielectric constant is located in at least one of maximum resonance current parts Z in the fundamental mode and the high-order mode.

FIG. 13A illustrates a specific example of a surface mount antenna 1 having the above-described structure. In the specific example shown in FIG. 13A, a dielectric substrate 2 includes two pieces of dielectric 15*a* and one piece of dielectric 15*b* having a dielectric constant greater than that of the pieces of dielectric 15*a*, wherein they are bonded into the form of a single piece via a ceramic adhesive or the like such that the piece of dielectric 15*b* is located between the two pieces of dielectric 15*a*. The piece of dielectric 15*b* with the high dielectric constant is disposed at a location corresponding to a maximum resonance current part Z (Z2) in the second-order mode.

As a result of disposing the piece of dielectric 15 *b* having the dielectric constant greater than that of the other pieces of dielectric at the location corresponding to the maximum resonance current part Z (Z2) in the second-order mode in the dielectric substrate 2, the capacitance between the maximum resonance current part Z (Z2) in the second-order mode in the feeding radiation electrode 3 and ground becomes greater than the capacitance between the other parts and ground. Because the capacitance between the maximum resonance current part Z (Z2) in the second-order mode and ground is disposed in parallel with the current path of the feeding radiation electrode 3, the parallel capacitance component C provides an equivalent series inductance component locally disposed in the maximum resonance current part Z (Z2) in the second-order mode, as described above with the reference to the third embodiment.

In the specific example shown in FIG. 13A, as described above, the piece of dielectric 15*b* having the dielectric constant greater than the dielectric constants of the other portions is disposed at the location corresponding to the maximum resonance current part Z (Z2) in the second-order mode in the dielectric substrate 2, so as to form the series inductance component locally in the maximum resonance current part Z (Z2) in the second-order mode in the feeding radiation electrode 3. That is, the piece of dielectric 15*b* serves to form the equivalent series inductance.

Another specific example is shown in FIG. 13B. In this example shown in FIG. 13B, in addition to the structure employed in the first embodiment described above with reference to FIG. 1, a piece of dielectric 15*b* serving to form equivalent series inductance is disposed at a location corresponding to a maximum resonance current part Z (Z2) in the second-order mode (that is, at a location where a meander pattern 4 is formed) as in the example shown in FIG. 13A. In the specific example shown in FIG. 13B, as a result of disposing the piece of dielectric 15B having the large dielectric constant, an equivalent series inductance component caused by a parallel capacitance component C having a greater value than the other portions between the meander pattern 4 and ground is formed in the maximum resonance current part Z (Z2) in the second-order mode in the feeding radiation electrode 3, in addition to a series inductance component provided by the meander pattern 4. Furthermore, the capacitance between meander lines d such as shown in FIG. 4 is increased by the piece of dielectric 15*b*, and the effect of the addition of the equivalent series inductance component is enhanced.

The structure employed to equivalently form a series inductance component using a dielectric material having a large dielectric constant is not limited to those shown in FIGS. 13A and 13B, and various other structures may also be employed. For example, instead of locally forming a series inductance component in the maximum resonance current part Z (Z2) in the second-order mode using a dielectric material having a large dielectric constant as in the examples shown in FIGS. 13A and 13B, an equivalent series inductance may be added in the maximum resonance current part Z (Z1) in the fundamental mode using a dielectric material having a large dielectric constant, In this case, for example, a piece of dielectric 15*b* having a large dielectric constant and serving to form the equivalent series inductance is disposed in the dielectric substrate 2, at a location corresponding to the maximum resonance current part Z (Z1) in the fundamental mode.

Equivalent series inductance components may be added locally in both maximum resonance current parts Z in the fundamental mode and the second-order mode, using a dielectric material having a large dielectric constant. In this case, for example, pieces of dielectrics 15*b* having a large dielectric constant and serving to form the equivalent series inductance are disposed in the dielectric substrate 2, at respective locations corresponding to the maximum resonance current parts Z (Z1) in the fundamental mode and the second-order mode.

Although in the specific examples shown in FIGS. 13A and 13B, the dielectric substrate 1 is made of plural different types of dielectric 15*a* and 15*b* bonded into the single piece, the dielectric substrate 1 may be formed such that, for example, a groove or a through-hole is formed in the dielectric substrate 2, at a location corresponding to one of or both of the maximum resonance current parts Z in the fundamental mode and the high-order mode and the groove or the through-hole is filled with a dielectric material having a larger dielectric constant than those of the other portions and serving to form equivalent series inductance. Alternatively, a piece of a plate-shaped (chip-shaped) dielectric material having a large dielectric constant may be bonded to the dielectric substrate 2, at a location corresponding to one of or both of the maximum resonance current parts Z in the fundamental mode and the high-order mode.

Although in the example shown in FIG. 13B, the structure characterizing the fourth embodiment is formed in the surface mount antenna 1 having the structure according to the first embodiment, the structure characterizing the fourth embodiment may be formed in the surface mount antenna 1 having the structure according to one of or any combination of the first to third embodiments.

Although the specific examples shown in FIGS. 13A and 13B are λ/4-resonance antennas of the direct excitation type which are designed to be mounted in a non-ground area, a similar structure according to the fourth embodiment may also be formed in other types of surface mount antennas such as a λ/4-resonance antenna of the capacitively exciting type which is designed to be mounted in a non-ground area, a λ/4-resonance antenna of the direct excitation type which is designed to be mounted in a ground area, a λ/4-resonance antenna of the capacitively exciting type which is designed to be mounted in a ground area, and a surface mount antenna in the inverted F type, so as to obtain great advantages similar to those described above.

In this fourth embodiment, as described above, the dielectric having the dielectric constant greater than those of the other portions and serving to form the equivalent series inductance is disposed in the dielectric substrate 2, at the location corresponding to at least one of the maximum resonance current parts Z in the fundamental modes and the high-order mode thereby locally forming the series inductance component in the maximum resonance current part Z in the fundamental mode or the high-order mode. Thus, the fourth embodiment provides great advantages similar to those obtained in the previous embodiments.

Now, a fifth embodiment is described below. In this fifth embodiment, similar parts to those of the previous embodiments are denoted by similar reference numerals and duplicated descriptions of them are not given herein.

The fifth embodiment is characterized in that a feeding radiation electrode 3 is formed in the shape of a helical pattern as shown in FIG. 14, and a series inductance component is added locally in one of or both of maximum resonance current parts Z in the fundamental mode and the high-order mode in the helical feeding radiation electrode 3.

In the feeding radiation electrode 3 formed in the shape of the helical pattern, if the line-to-line distance of the helical pattern is locally reduced as is the case in a part P shown in FIG. 14, the inductance is locally increased. The value of the locally increased inductance can be varied by varying the number of helical lines or the line-to-line distance or by locally varying the dielectric constant of the dielectric substrate 2 as performed in the fourth embodiment. This is utilized in the fifth embodiment to locally form a series inductance in one of or both of maximum resonance current parts in the fundamental mode and the high-order mode.

That is, in this fifth embodiment, in the surface mount antenna 1 including the helical feeding radiation electrode 3, the series inductance component is locally formed in one of or both of the maximum resonance current parts in the fundamental mode and the high-order mode, and thus great advantages similar to those obtained in the previous embodiments are also obtained.

Now, a sixth embodiment is described below. In this sixth embodiment, similar parts to those of the previous embodiments are denoted by similar reference numerals and duplicated descriptions of them are not given herein.

The sixth embodiment is characterized in that in a surface mount antenna 1 including a non-feeding radiation electrode 20 as well as a feeding radiation electrode 3 both formed on the surface of a dielectric substrate 2, a series inductance component is locally added in one of or both of maximum resonance current parts Z in the fundamental mode and the high-order mode in the feeding radiation electrode 3 in a similar manner to the previous embodiments as shown in FIGS. 15 to 17.

In the examples shown in FIGS. 15 and 16, each surface mount antenna 1 includes one non-feeding radiation electrode 20. If the resonance frequency f of the non-feeding radiation electrode 20 is set to be close to the resonance frequency f1 in the fundamental mode of the feeding radiation electrode 3, the non-feeding radiation electrode 20 provides multiple resonance in conjunction with a resonance wave in the fundamental mode provided by the feeding radiation electrode 3 as represented by a frequency characteristic diagram shown in FIG. 18A, and thus expansion of the bandwidth in the fundamental mode is achieved.

On the other hand, if the resonance frequency f of the non-feeding radiation electrode 20 is set to be close to the resonance frequency f2 in the high-order mode of the feeding radiation electrode 3, the non-feeding radiation electrode 20 provides multiple resonance in conjunction with a resonance wave in the high-order mode provided by the feeding radiation electrode 3 as represented by a frequency characteristic diagram shown in FIG. 18C, and thus expansion of the bandwidth in the high-order mode is achieved.

In the example shown in FIG. 17, each surface mount antenna 1 includes two non-feeding radiation electrodes 20 (20*a*, 20*b*). If the resonance frequencies fa and fb of the respective non-feeding radiation electrodes 20*a* and 20*b* are set to be slightly different from each other and close to the resonance frequency f1 in the fundamental mode of the feeding radiation electrode 3, triple resonance occurs in the fundamental mode associated with the feeding radiation electrode 3 as shown in FIG. 18B, and thus further expansion of the bandwidth in the fundamental mode associated with the feeding radiation electrode 3 is achieved.

Figure 18D:
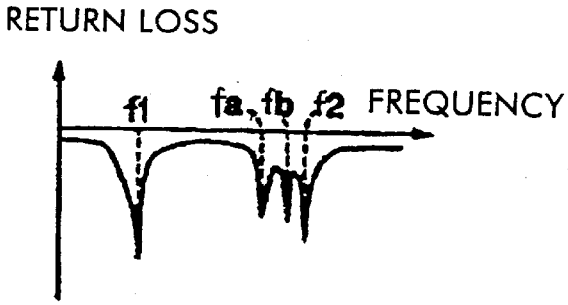

On the other hand, if the resonance frequencies fa and fb of the respective non-feeding radiation electrodes 20*a* and 20*b* are set to be slightly different from each other and close to the resonance frequency f2 in the fundamental mode of the feeding radiation electrode 3, triple resonance occurs in the high-order mode associated with the feeding radiation electrode 3 as shown in FIG. 18D, and thus further expansion of the bandwidth in the high-order mode associated with the feeding radiation electrode 3 is achieved.

Figure 18E:
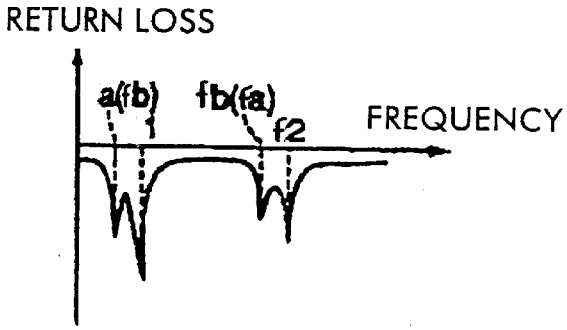

Alternatively, one of the resonance frequencies of the non-feeding radiation electrodes 20*a* and 20*b* may be set to be close to the resonance frequency f1 in the fundamental mode of the feeding radiation electrode 3, and the other one of the resonance frequencies of the non-feeding radiation electrodes 20*a* and 20*b* may be set to be close to the resonance frequency f2 in the high-order mode of the feeding radiation electrode 3, so that multiple resonance occurs in both fundamental mode and high-order mode associated with the feeding radiation electrode 3 as shown in FIG. 18E, thereby achieving expansion of the bandwidths in both fundamental mode and high-order mode.

In the specific examples shown in FIGS. 15 to 17, a meander pattern 4 is formed in a maximum resonance current part Z in the high-order mode in the feeding radiation electrode 3 so as to locally provide a series inductance component as in the first embodiment, and thus great advantages similar to those obtained in the first embodiment are obtained.

Figure 15A:
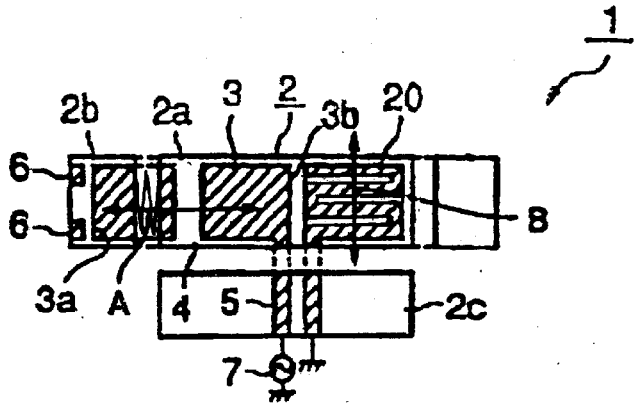
Figure 15B:
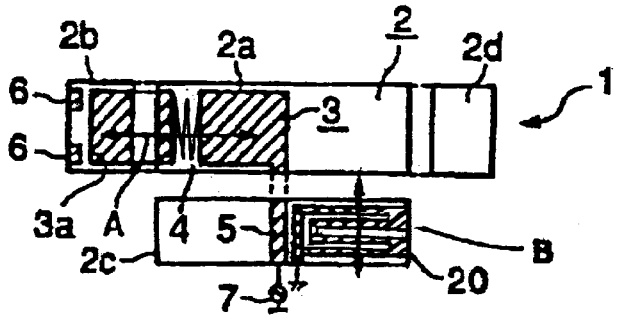

The surface mount antennas 1 shown in FIGS. 15A and 15B are of the λ/4-resonance direct-excitation type designed to be mounted in a non-ground area. In the example shown in FIG. 15A, a meander-shaped non-feeding radiation electrode 20 is formed on the upper surface 2*a* of a dielectric substrate 2, while in the example shown in FIG. 15B, a meander-shaped non-feeding radiation electrode 20 is formed on a side face 2*c* of a dielectric substrate 2. Except for the above, the surface mount antennas 1 shown in FIGS. 15A and 15B are similar in structure to each other.

Figure 15C:
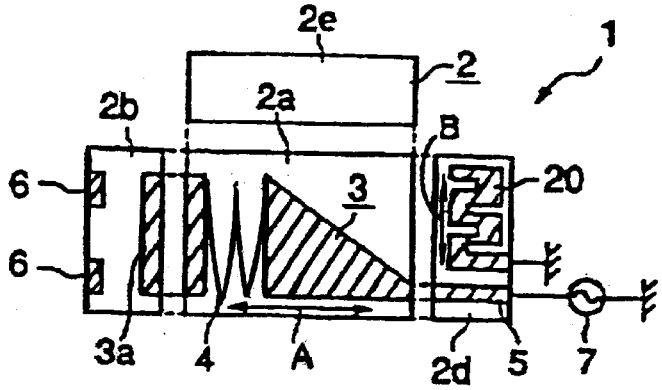
Figure 15D:
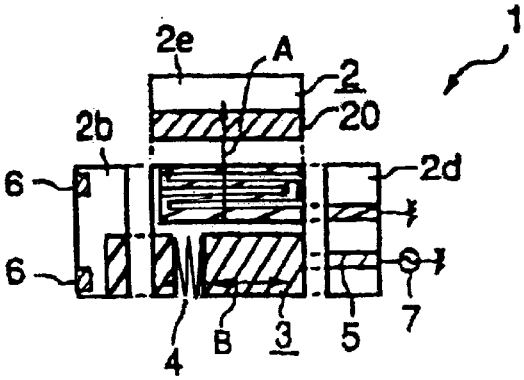

The surface mount antennas 1 shown in FIGS. 15C and 15D are of the λ/4resonance direct-excitation type designed to be mounted in a ground area. In the example shown in FIG. 15C, a meander-shaped non-feeding radiation electrode 20 is formed on a side face 2*d* of a dielectric substrate 2. In the example shown in FIG. 15D, a meander-shaped non-feeding radiation electrode 20 is formed such that it extends from the upper surface 2*a* onto a side face 2*e* of a dielectric substrate 2. In the example shown in FIG. 15C, the feeding radiation electrode 3 is formed such that its width increases from the side of a feeding electrode 5 to a meander pattern 4, while the width of the feeding radiation electrode 3 in the example shown in FIG. 15D is substantially fixed over the entire length from one end to the opposite end. Except for the above, the surface mount antennas 1 shown in FIGS. 15C and 15D are similar in structure to each other.

In the respective surface mount antennas 1 shown in FIGS. 15A to 15D, the vector direction of the current flow through the feeding radiation electrode 3 is denoted by an arrow A in the respective figures, and the vector direction of the current flow through the non-feeding radiation electrode 20 is denoted by an arrow B in the respective figures, wherein the vector direction A of the current flow through the feeding radiation electrode 3 and the vector direction B of the current flow through the non-feeding radiation electrode 20 are substantially perpendicular to each other.

Because the vector direction A of the current flow through the feeding radiation electrode 3 and the vector direction B of the current flow through the non-feeding radiation electrode 20 are substantially perpendicular to each other, the feeding radiation electrode 3 and the non-feeding radiation electrode 20 can provide stable multiple resonance without causing mutual interference. This makes it possible to realize a wideband surface mount antenna 1 having high reliability in terms of the frequency characteristic.

Figure 16A:
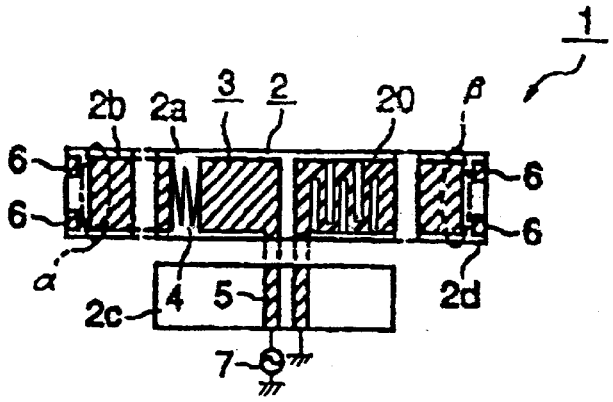
Figure 16B:
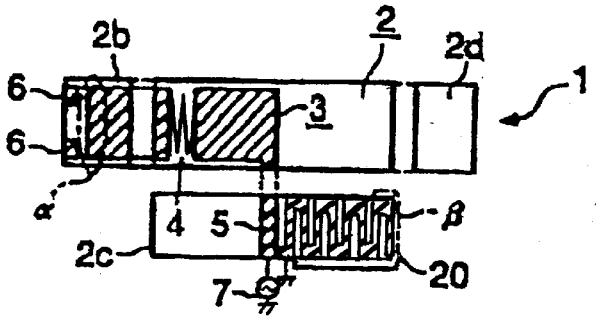

The surface mount antennas 1 shown in FIGS. 16A and 15B are of the λ/4resonance direct-excitation type designed to be mounted in a non-ground area. In the surface mount antenna 1 shown in FIG. 15A, a meander-shaped non-feeding radiation electrode 20 is formed such that it extends from the upper surface 2*a* onto a side face 2*d* of a dielectric substrate 2, while in the surface mount antenna 1 shown in FIG. 15B, a meander-shaped non-feeding radiation electrode 20 is formed on a side face 2*c* of a dielectric substrate 2. Except for the above, the surface mount antennas 1 shown in FIGS. 16A and 16B are similar in structure to each other.

Figure 16C:
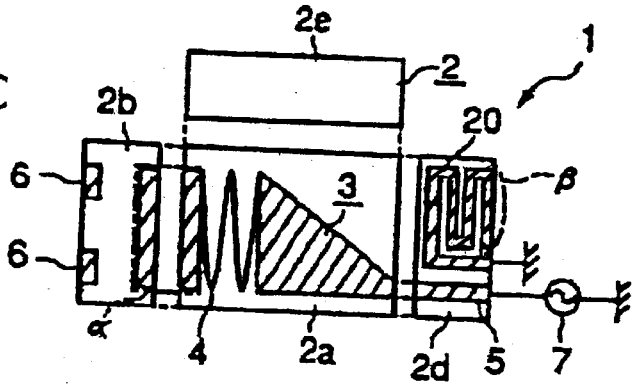
Figure 16D:
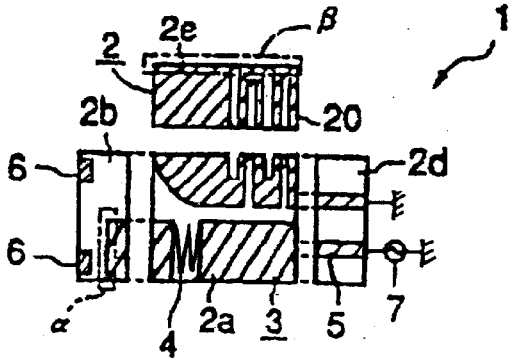

The surface mount antennas 1 shown in FIGS. 16C and 16D are of the λ/4-resonance direct-excitation type designed to be mounted in a ground area. In the surface mount antenna 1 shown in FIG. 15C, a meander-shaped non-feeding radiation electrode 20 is formed on a side face 2*d* of a dielectric substrate 2, while in the surface mount antenna 1 shown in FIG. 16D, a meander-shaped non-feeding radiation electrode 20 is formed such that it extends from the upper surface 2*a* onto a side face 2*e* of a dielectric substrate 2. In the surface mount antenna 1 shown in FIG. 16C, the feeding radiation electrode 3 is formed such that its width increases from the side of a feeding electrode 5 to a meander pattern 4, while the width of the feeding radiation electrode 3 in the surface mount antenna 1 shown in FIG. 16D is substantially fixed over the entire length from one end to the opposite end. Except for the above, the surface mount antennas 1 shown in FIGS. 16C and 16D are similar in structure to each other.

In the specific examples shown in FIGS. 16A to 16D, the electric field associated with the feeding radiation electrode 3 becomes maximum in a part surrounded by a broken line a, and the electric field associated with the non-feeding radiation electrode 20 becomes maximum in a part surrounded by a broken line b, wherein the part a in which the electric field associated with the feeding radiation electrode 3 becomes maximum and the part b in which the electric field associated with the non-feeding radiation electrode 20 becomes maximum are far apart from each other. Because the part a in which the electric field associated with the feeding radiation electrode 3 becomes maximum and the part b in which the electric field associated with the non-feeding radiation electrode 20 becomes maximum are far apart from each other as shown in FIGS. 16A to 16D, the feeding radiation electrode 3 and the non-feeding radiation electrode 20 can provide stable multiple resonance without causing mutual interference, thereby ensuring that a wide bandwidth can be achieved without any problem.

On the other hand, in the specific examples shown in FIGS. 17A to 17C, as described above, each surface mount antenna 1 includes two non-feeding radiation electrodes 20*a* and 20*b* so as to achieve further expansion of the bandwidth. As can be seen, there are differences in shapes and locations of the non-feeding radiation electrodes 20*a* and 20*b* among the examples shown in FIGS. 17A to 17C. Except for the above, they are similar in structure.

In the surface mount antenna 1 according to the sixth embodiment in which expansion of the bandwidth is achieved by means of multiple resonance using the feeding radiation electrode 3 and the non-feeding radiation electrode 20, great advantages similar to those obtained in the previous embodiments are also obtained by forming the feeding radiation electrode 3 so as to have one of structures employed in the previous embodiments.

In the specific examples shown in FIGS. 15 to 17, a series inductance component is added in the maximum resonance current part Z in the high-order mode in the feeding radiation electrode 3. Alternatively, of course, a series inductance component may be locally added not in the maximum resonance current part Z in the high-order mode but in that in the fundamental mode in the feeding radiation electrode formed on the surface mount antenna. Furthermore, as in the second embodiment, series inductance components may be locally added in both maximum resonance current parts Z in the fundamental mode and the high-order mode in the feeding radiation electrode 3.

Furthermore, a series inductance component may also be locally added in one of or both of the maximum resonance current parts Z in the fundamental mode and the high-order mode using a parallel capacitance component C as in the third embodiment, or using a dielectric material having a high dielectric constant for providing an equivalent series inductance as in the fourth embodiment, or otherwise using any combination of the first to fourth embodiment.

Although the surface mount antennas 1 shown in FIGS. 15 to 17 are of the direct excitation type, a similar structure employed in any embodiment may also be applied to other types of surface mount antennas such as a capacitive coupling type, a helical type, or an inverted F type, thereby achieving great advantages similar to those obtained in the respective embodiments.

Now, a seventh embodiment is described below. In this seventh embodiment, similar parts to those of the previous embodiments are denoted by similar reference numerals and duplicated descriptions of them are not given herein.

The seventh embodiment is characterized in that in a surface mount antenna 1 including both a feeding radiation electrode 3 and a non-feeding radiation electrode 20, a series inductance component is locally added in one of or both of maximum resonance current parts in the fundamental mode and the high-order mode not only in the feeding radiation electrode 3 but also in the non-feeding radiation electrode 20, by employing one of techniques disclosed in the previous embodiments. In other words, in this seventh embodiment, not only the feeding radiation electrode 3 but also the non-feeding radiation electrode 20 is formed so as to include a series of parts which are arranged such that the electrical length per unit physical length is alternately large and small from one part to another.

Specific examples of surface mount antennas 1 constructed in the above-described manner are shown in FIGS. 19A to 19C, 20A and 20B. In the surface mount antennas 1 shown in FIGS. 19A to 19C, 20A, and 20B, a meander pattern 4 is locally formed in a feeding radiation electrode 3 and a meander pattern 21 is locally formed in a non-feeding radiation electrode 20 so that the meander patterns 4 and 21 provide series inductance components locally in maximum resonance current parts Z in the high-order mode in the feeding radiation electrode 3 and the non-feeding radiation electrode 20, respectively.

The surface mount antennas 1 shown in FIGS. 19A to 19C are of the $\lambda/4$-resonance direct-excitation type designed to be mounted in a ground area. In the surface mount antennas 1 shown in FIGS. 19A and 19C, the vector direction A of the current flow through the feeding radiation electrode 3 and the vector direction B of the current flow through the non-feeding radiation electrode 20 are substantially perpendicular to each other, and thus it is ensured that the feeding radiation electrode 3 and the non-feeding radiation electrode 20 can provide stable multiple resonance without causing mutual interference. Furthermore, in the surface mount antennas 1 shown in FIGS. 19A to 19C, a part a in which the electric field associated with the feeding radiation electrode 3 becomes maximum and a part b in which the electric field associated with the non-feeding radiation electrode 20 becomes maximum are far apart from each other so as to ensure that the feeding radiation electrode 3 and the non-feeding radiation electrode 20 can provide stable multiple resonance without causing mutual interference.

The surface mount antennas 1 shown in FIGS. 20A and 20B are of the $\lambda/4$-resonance direct-excitation type designed to be mounted in a non-ground area. In the surface mount antenna 1 shown in FIG. 20A, as in those shown in FIGS. 19A and 19C, the vector direction A of the current flow through the feeding radiation electrode 3 and the vector direction B of the current flow through the non-feeding radiation electrode 20 are substantially perpendicular to each other. In the surface mount antenna 1 shown in FIG. 20B, as in those shown in FIGS. 19A to 19C, a part a in which the electric field associated with the feeding radiation electrode 3 becomes maximum and a part b in which the electric field associated with the non-feeding radiation electrode 20 becomes maximum are far apart from each other. Employing such structures in the surface mount antennas 1 shown in FIGS. 20A and 20B makes it possible to achieve stable multiple resonance without having interference between the feeding radiation electrode 3 and the non-feeding radiation electrode 20.

In the surface mount antenna 1 of the multiple resonance type according to the seventh embodiment, the series inductance component is locally added not only in the feeding radiation electrode 3 but also in the non-feeding radiation electrode 20, by employing one of techniques disclosed in the previous embodiments, as described above, thereby making it possible to easily vary and set the resonance frequency associated with the non-feeding radiation electrode 20 to a desired value. Thus, it becomes still easier to provide a surface mount antenna 1 which satisfies the requirements needed in multi-band applications.

The seventh embodiment has been described above with reference to the specific examples shown in FIGS. 19A to 19C, 20A, and 20B. However, the seventh embodiment is not limited to those specific embodiments shown in FIGS. 19A to 19C, 20A, and 20B. For example, although in the examples shown in FIGS. 19A to 19C, 20A, and 20B, the series inductance component is added locally in the maximum resonance current parts Z in the high-order mode in the feeding radiation electrode 3 and the non-feeding radiation electrode 20, a series inductance component may be locally added not in the maximum resonance current part Z in the high-order mode but in that in the fundamental mode, or series inductance components may be locally added in both maximum resonance current parts Z in the fundamental mode and the high-order mode.

Furthermore, instead of using a meander pattern to form a series inductance component, parallel capacitance, a dielectric material for forming an equivalent series inductance, or other means disclosed in the previous embodiments may be employed to locally add a series inductance component.

Although the surface mount antennas shown in FIGS. 19A to 19C, 20A, and 20B are of the direct excitation type, the seventh embodiment may also be applied to other types of surface mount antennas such as a capacitive coupling type, a helical type, or an inverted F type. Also in this case, great advantages similar to those described above are obtained.

Now, an eighth embodiment is described below. In this eighth embodiment, an example of a communication device according to the present invention is disclosed. More specifically, a portable telephone such as that shown in FIG. 21 is disclosed herein as a communication device according to the eighth embodiment. The portable telephone 30 includes a circuit board 32 disposed in a case 31, and a surface mount antenna 1 constructed according to one of embodiments described above is mounted on the circuit board 32.

On the circuit board 32 of the portable telephone, as shown in FIG. 21, there are also provided a transmitting circuit 33, a receiving circuit 34, and a duplexer 35. The surface mount antenna 1 is mounted on the circuit board 32 such that it is electrically connected to the transmitting circuit 33 or the receiving circuit 34 via the duplexer 35. In this portable telephone 30, transmitting and receiving operations are switched between each other by the duplexer 35.

In this eighth embodiment, because the portable telephone 30 includes the dual-band surface mount antenna constructed according to one of the embodiments described earlier, the portable telephone 30 is capable of transmitting and receiving signals in two different frequency bands using the same single surface mount antenna 1. Furthermore, the resonance frequencies in the fundamental mode and the high-order mode associated with the feeding radiation electrode 3 can be precisely set to a desired values, it is possible to provide a communication device having a high-performance high-reliability antenna characteristic.

As described earlier, the surface mount antenna 1 constructed according to one of the previous embodiments can be provided at low cost, and thus the communication device including the low-cost surface mount antenna 1 can also be provided at low cost.

Although the present invention has been described above with the specific embodiments, the invention is not limited to those embodiments. For example, although in the eighth embodiment, the portable telephone 30 has been described as an example of the communication device, the present invention may also be applied to other types of radio communication devices.

As can be understood from the above description, the present invention provides great advantages as described below. That is, in the surface mount antenna according to the present invention, a series of parts is formed along the current path of the feeding radiation electrode such that the electrical length per unit physical length is alternately large and small from one part to another, thereby making it possible to control the difference between the resonance frequency in the fundamental mode and that in the high-order mode over a wide range. In particular, when a series inductance component is added locally in one of or both of maximum resonance current parts in the fundamental mode and the high-order mode in the feeding radiation electrode of the surface mount antenna thereby forming a part having a large electrical length, it is possible to precisely control the difference between the resonance frequency in the fundamental mode and that in the high-order mode.

Simply by varying the value of the series inductance component described above, it is possible to adjust and set the resonance frequency in the mode associated with the above added series inductance independently of the resonance frequency in the other mode (fundamental mode or the high-order mode). Thus, it becomes easier to vary and set the respective resonance frequencies in the fundamental mode and the high-order mode, and the degree of freedom for the design of the antenna for use in multi-band applications is expanded.

Therefore, it is possible to easily and efficiently design the surface mount antenna so as to have a desired frequency characteristic. Besides, when the resonance frequency is set by the series inductance component, the resonance frequency can be controlled easily and precisely. Thus, the present invention provides very great advantages that the surface mount antenna having improved performance and reliability can be provided at lower cost.

A series inductance component for forming a part having a large electrical length can be realized by forming a meander pattern in a feeding radiation electrode or adding an equivalent series inductance component using a parallel capacitance component or otherwise by locally disposing a dielectric material having a large dielectric constant. In any case, a series inductance component can be added in one of or both of maximum resonance current parts in the fundamental mode and the high-order mode without causing an increase in the size of the surface mount antenna. The value of the series inductance component can be easily varied over a very large range, and thus the resonance frequency in the mode associated with the added series inductance component can be controlled, adjusted, and set over a very large range.

If a feeding radiation electrode is formed in the shape of a helical pattern and a series inductance component is provided by locally decreasing the line-to-line distance of the helical pattern in one or both of maximum resonance current parts in the fundamental mode and the high-order mode, a surface mount antenna of the helical type having great advantages similar to those described above can be realized. Also in the case of a Surface mount antenna of the multiple resonance type having a feeding radiation electrode and a non-feeding radiation electrode, similar great advantages can be obtained by adding a series inductance component in one of or both of maximum resonance current parts in the fundamental mode and the high-order mode in the feeding radiation electrode.

Furthermore, in the surface mount antenna of the multiple resonance type, a series inductance component may be added not only to the feeding radiation electrode but also to the non-feeding radiation electrode, or the non-feeding radiation electrode may be formed of a series of parts arranged such that the electrical length becomes alternately large and small from one part to another. In this case, it becomes easy to adjust and set not only the resonance frequency associated with the feeding radiation electrode but also the resonance frequency associated with the non-feeding radiation electrode, and thus it becomes possible to efficiently provide a surface mount antenna having a desired wideband frequency characteristic achieved by means of multiple resonance, at low cost.

Furthermore, in the surface mount antenna of the multiple resonance type, the feeding radiation electrode and the non-feeding radiation electrode may be formed such that the vector direction of a current flow through the feeding radiation electrode and the vector direction of a current flow through the non-feeding radiation electrode become substantially perpendicular to each other, and/or such that a part in which the electric field associated with the feeding radiation electrode becomes maximum and a part in which the electric field associated with the non-feeding radiation electrode becomes maximum are far apart from each other, thereby preventing feeding radiation electrode and the non-feeding radiation electrode from interfering with each other and thus achieving stable multiple resonance.

The present invention also provides a communication device with a surface mount antenna having the above-described advantages. That is, it is possible to provide a communication device having a highly reliable antenna characteristic. While preferred embodiments of the invention have been disclosed, various modes of carrying out the principles disclosed herein are contemplated as being within the scope of the following claims. Therefore, it is understood that the scope of the invention is not to be limited except as otherwise set forth in the claims.

What is claimed is:

1. A surface mount antenna comprising:

a dielectric substrate; and a radiating electrode formed on the dielectric substrate, one end of said radiating electrode being an open end, one of a feeding electrode and a ground terminal being formed on an opposite end of said radiating electrode, wherein the radiating electrode includes a first part having a small electrical length per unit physical length and a second part having a greater electrical length than the small electrical length of the first part, the first part and the second part being arranged in series along a current path between the one end and the opposite end.

2. A surface mount antenna comprising:

a dielectric substrate; and a radiating electrode formed on the dielectric substrate, one end of the radiating electrode being an open end, one of a feeding electrode and a ground terminal being formed on an opposite end of the radiating electrode, wherein the radiating electrode includes a first part in which a resonance current in a fundamental mode becomes maximum and a second part in which a resonance current in a high-order mode becomes maximum, the first part and the second part being arranged in series along a current path between the one end and the opposite end; and at least one of the first and second parts includes an inductance component disposed in series in the current path.

3. The surface mount antenna of claim 2, wherein the inductance component is formed by a meander electrode pattern.

4. The surface mount antenna of claim 2, wherein the inductance component is formed by a capacitance component connected in parallel to at least one of the first part and the second part.

5. The surface mount antenna of claim 2, wherein the radiating electrode is formed by a helical electrode pattern, and the inductance component is formed by reducing a distance between adjacent electrodes of the helical electrode pattern.

6. The surface mount antenna of claim 2, wherein the inductance component is formed by a member having a high dielectric constant, the member being disposed in at least one of the first part and the second part.

7. The surface mount antenna of claim 2, further comprising a non-feeding radiation electrode formed adjacent the radiating electrode, a resonance mode associated with the non-feeding radiation electrode forming multiple resonances in conjunction with at least one of the fundamental mode and the high-order mode associated with an externally-connected electrode.

8. The surface mount antenna of claim 7, wherein the non-feeding radiation electrode includes a part having a small electrical length per unit physical length and a part having a greater electrical length than the small electrical length, the parts being arranged in series along a path of a current flowing through the non-feeding radiation electrode.

9. The surface mount antenna of claim 7, wherein the non-feeding radiation electrode includes a first part in which a resonance current in a fundamental mode becomes maximum and a second part in which a resonance current in a high-order mode becomes maximum, said first part and said second part being arranged in series along a path of a current flowing through said non-feeding radiation electrode, and at least one of said first and second parts includes an inductance component disposed in series in the current path.

10. The surface mount antenna of claim 9, wherein the inductance component is formed by a meander electrode pattern.

11. The surface mount antenna of claim 9, wherein the inductance component is formed by a capacitance component connected in parallel to at least one of said first part and said second part.

12. The surface mount antenna of claim 9, wherein the radiating electrode is formed by a helical electrode pattern, and the inductance component is formed by reducing a distance between adjacent electrodes of the helical electrode pattern.

13. The surface mount antenna of claim 9, wherein said inductance component is formed by a member having a high dielectric constant, said member being disposed in at least one of said first part and said second part.

14. The surface mount antenna of claim 7, wherein a vector direction of a current flowing though the radiating electrode and a vector direction of a current flowing though the non-feeding radiation electrode are perpendicular to each other.

15. A communication device comprising at least one of a transmitting circuit and a receiving circuit, and further comprising a surface mount antenna mounted on a substrate coupled to the at least one of a transmitting circuit and receiving circuit, the surface mount antenna comprising:

a dielectric substrate; and a radiating electrode formed on the dielectric substrate, one end of said radiating electrode being an open end, one of a feeding electrode and a ground terminal being formed on an opposite end of said radiating electrode, wherein the radiating electrode includes a first part having a small electrical length per unit physical length and a second part having a greater electrical length than the small electrical length of the first part, the first part and the second part being arranged in series along a current path between the one end and the opposite end.

16. A communication device comprising at least one of a transmitting circuit and a receiving circuit, and further comprising a surface mount antenna mounted on a substrate and coupled to the at least one of a transmitting circuit and receiving circuit, the surface mount antenna comprising:

a dielectric substrate; and a radiating electrode formed on the dielectric substrate, one end of the radiating electrode being an open end, one of a feeding electrode and a ground terminal being formed on an opposite end of the radiating electrode, wherein the radiating electrode includes a first part in which a resonance current in a fundamental mode becomes maximum and a second part in which a resonance current in a high-order mode becomes maximum, the first part and the second part being arranged in series along a current path between the one end and the opposite end; and at least one of the first and second parts includes an inductance component disposed in series in the current path.

17. The communication device of claim 16, wherein the inductance component is formed by a meander electrode pattern.

18. The communication device of claim 16, wherein the inductance component is formed by a capacitance component connected in parallel to at least one of the first part and the second part.

19. The communication device of claim 16, wherein the radiating electrode is formed by a helical electrode pattern, and the inductance component is formed by reducing a distance between adjacent electrodes of the helical electrode pattern.

20. The communication device of according to claim 16, wherein the inductance component is formed by a member having a high dielectric constant, the member being disposed in at least one of the first part and the second part.

21. The communication device of claim 16, further comprising a non-feeding radiation electrode formed adjacent the radiating electrode, a resonance mode associated with the non-feeding radiation electrode forming multiple resonances in conjunction with at least one of the fundamental mode and the high-order mode associated with an externally-connected electrode.

22. The communication device of claim 21, wherein the non-feeding radiation electrode includes a part having a small electrical length per unit physical length and a part having a greater electrical length than the small electrical length, the parts being arranged in series along a path of a current flowing through the non-feeding radiation electrode.

23. The communication device of claim 21, wherein the non-feeding radiation electrode includes a first part in which a resonance current in a fundamental mode becomes maximum and a second part in which a resonance current in a high-order mode becomes maximum, said first part and said second part being arranged in series along a path of a current flowing through said non-feeding radiation electrode, and at least one of said first and second parts includes an inductance component disposed in series in the current path.

24. The communication device of claim 23, wherein the inductance component is formed by a meander electrode pattern.

25. The communication device of claim 23, wherein the inductance component is formed by a capacitance component connected in parallel to at least one of said first part and said second part.

26. The communication device of claim 23, wherein the radiating electrode is formed by a helical electrode pattern, and the inductance component is formed by reducing a distance between adjacent electrodes of the helical electrode pattern.

27. The communication device of claim 23, wherein said inductance component is formed by a member having a high dielectric constant, said member being disposed in at least one of said first part and said second part.

28. The communication device of claim 21, wherein a vector direction of a current flowing though the radiating electrode and a vector direction of a current flowing though the non-feeding radiation electrode are perpendicular to each other.

* * * * *